US010473045B2

(12) United States Patent
Aikawa

(10) Patent No.: US 10,473,045 B2
(45) Date of Patent: Nov. 12, 2019

(54) CONTROL APPARATUS FOR INTERNAL COMBUSTION ENGINE

(71) Applicant: TOYOTA JIDOSHA KABUSHIKI KAISHA, Toyota-shi (JP)

(72) Inventor: Hidefumi Aikawa, Sunto-gun (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 53 days.

(21) Appl. No.: 14/767,383

(22) PCT Filed: Feb. 25, 2013

(86) PCT No.: PCT/JP2013/054817
§ 371 (c)(1),
(2) Date: Aug. 12, 2015

(87) PCT Pub. No.: WO2014/128974
PCT Pub. Date: Aug. 28, 2014

(65) Prior Publication Data

US 2016/0003177 A1 Jan. 7, 2016

(51) Int. Cl.
*F02D 41/00* (2006.01)
*F02D 17/00* (2006.01)
(Continued)

(52) U.S. Cl.
CPC ..... *F02D 41/0087* (2013.01); *F02D 17/00* (2013.01); *F02D 17/02* (2013.01);
(Continued)

(58) Field of Classification Search
CPC ..... F02D 41/0087; F02D 17/00; F02D 17/02; F02D 17/023; F02D 17/026;
(Continued)

(56) References Cited

U.S. PATENT DOCUMENTS

2002/0093202 A1* 7/2002 Downs ..... B60K 6/485 290/40 R
2003/0101956 A1* 6/2003 Sieber ..... F02N 9/02 123/179.5
2003/0172892 A1* 9/2003 Glugla ..... F02B 75/22 123/179.5
2004/0107945 A1* 6/2004 Yeo ..... F02B 77/086 123/479
(Continued)

FOREIGN PATENT DOCUMENTS

DE 102009045686 4/2011
JP 2004 225561 8/2004
(Continued)

OTHER PUBLICATIONS

International Search Report dated Apr. 9, 2013 in PCT/JP2013/054817 Filed Feb. 25, 2013.

*Primary Examiner* — Grant Moubry
*Assistant Examiner* — Joshua Campbell
(74) *Attorney, Agent, or Firm* — Oblon, McClelland, Maier & Neustadt, L.L.P.

(57) ABSTRACT

A control apparatus is applied to an internal combustion engine that is capable of implementing reduced-cylinder operation and all-cylinder operation. When the internal combustion engine is stopped during implementation of reduced-cylinder operation, and then the internal combustion engine is restarted in reduced-cylinder operation with the same cylinders as idling cylinders, the initial crank angle when cranking starts is controlled so that the position of the piston of at least one among the idling cylinders is in the vicinity of its top dead center.

7 Claims, 26 Drawing Sheets

(51) Int. Cl.

| | |
|---|---|
| ***F02D 29/02*** | (2006.01) |
| ***F02D 41/04*** | (2006.01) |
| ***F02D 41/06*** | (2006.01) |
| ***F02D 17/02*** | (2006.01) |
| *F02N 19/00* | (2010.01) |

(52) U.S. Cl.
CPC ..... *F02D 29/02* (2013.01); *F02D 41/008* (2013.01); *F02D 41/042* (2013.01); *F02D 41/062* (2013.01); *F02D 17/023* (2013.01); *F02D 17/026* (2013.01); *F02D 2041/0092* (2013.01); *F02D 2041/0095* (2013.01); *F02N 19/004* (2013.01)

(58) Field of Classification Search
CPC ..... F02D 2041/0092; F02D 2041/0095; F02D 29/02; F02D 41/008; F02D 41/042; F02D 41/062; F02N 19/004
See application file for complete search history.

(56) References Cited

U.S. PATENT DOCUMENTS

| | | | | |
|---|---|---|---|---|
| 2005/0229889 | A1* | 10/2005 | Hoevermann | F02D 41/009 123/179.4 |
| 2007/0163531 | A1* | 7/2007 | Lewis | F01L 9/02 123/179.4 |
| 2008/0105230 | A1* | 5/2008 | Kishibata | F02D 41/062 123/179.5 |
| 2009/0042458 | A1* | 2/2009 | Kinoshita | B63B 35/731 440/1 |
| 2012/0204827 | A1 | 8/2012 | Sieber et al. | |

FOREIGN PATENT DOCUMENTS

| | | | | |
|---|---|---|---|---|
| JP | 2007120404 A | * | 5/2007 | |
| JP | 4075508 | | 4/2008 | |
| JP | 4075508 B2 | * | 4/2008 | F02N 19/005 |
| JP | 2010 71188 | | 4/2010 | |
| JP | 2010071188 A | * | 4/2010 | |

* cited by examiner

INT : INTAKE EXP : EXPANSION
COM : COMPRESSION EXH : EXHAUST

INT : INTAKE EXP : EXPANSION
COM : COMPRESSION EXH : EXHAUST

INT : INTAKE EXP : EXPANSION
COM : COMPRESSION EXH : EXHAUST

INT : INTAKE EXP : EXPANSION
COM : COMPRESSION EXH : EXHAUST

CONTROL APPARATUS FOR INTERNAL COMBUSTION ENGINE

TECHNICAL FIELD

The present invention relates to a control apparatus for an internal combustion engine that is applied to an internal combustion engine which is capable of implementing reduced-cylinder operation.

BACKGROUND ART

A control apparatus for an internal combustion engine is per se known that controls piston position to its compression top dead center when the internal combustion engine is stopped, thus reducing the torque needed for cranking during restarting (refer to Patent Document #1). Apart from the above, Patent Documents #2 and #3 in the following Citation List may be considered to have some relevance to the present invention.

CITATION LIST

Patent Literature

Patent Document #1: JP4075508B.
Patent Document #2: JP2010-71188A.
Patent Document #3: JP2004-225561A.

SUMMARY OF INVENTION

Technical Problem

An internal combustion engine is per se known that is capable of implementing both reduced-cylinder operation in which, in order to enhance the fuel consumption, a part of the plurality of cylinders is idled by being stopped in the state in which their intake valve and their exhaust valve are closed and the remaining cylinder is operated, and also all-cylinder operation in which all of the plurality of cylinders are operated. With this type of internal combustion engine, when restarting in reduced-cylinder operation after having stopped during implementation of reduced-cylinder operation, since the idling cylinders are in the state in which their intake valve and their exhaust valve are closed, accordingly compression and expansion of volumes of air determined by the piston position when cranking starts is repeatedly performed.

When the control apparatus of Patent Document #1 is applied to an internal combustion engine of this type, and the piston position of a working cylinder when the internal combustion engine is stopped is controlled to be at its compression top dead center, then in some cases the piston position of an idling cylinder is at its bottom dead center. Since the volume of the cylinder is maximum when the piston position of an idling cylinder is at its bottom dead center, accordingly it is necessary to compress the maximum volume of air while performing cranking during restarting. Due to this, as compared to the case of starting cranking with the piston at a position away from its bottom dead center, the torque due to cranking resistance (i.e. the frictional torque) becomes greater, and moreover the level of vibration becomes greater, since the torque fluctuations due to the compression reaction force also become greater.

Accordingly, the object of the present invention is to provide a control apparatus for an internal combustion engine that is capable of suppressing vibration during restarting.

Solution to Technical Problem

The control apparatus for an internal combustion engine according to the present invention is applied to an internal combustion engine that has a plurality of four or more cylinders and that is capable of implementing both reduced-cylinder operation in which a portion among the plurality of cylinders is idled by stopping their intake valve and their exhaust valve in a closed state while a remaining cylinder operates and all-cylinder operation in which all of the plurality of cylinders operate, and that moreover is started by cranking by an electric motor, comprising a crank angle control device configured to control an initial crank angle when cranking is started by controlling the electric motor, wherein, when the internal combustion engine is stopped during implementation of the reduced-cylinder operation and then the internal combustion engine is restarted in the reduced-cylinder operation with the same cylinders as idling cylinders, the crank angle control device controls the initial crank angle so that piston position of at least one cylinder among the idling cylinders is in vicinity of its top dead center.

According to this control apparatus, when restarting in reduced-cylinder operation, cranking is started in the state in which the cylinder volume of at least one of the idling cylinders is sufficiently smaller than its maximum volume. In other words, cranking is started with the cylinder volume of at least one of the idling cylinders at its minimum volume or at a volume close to its minimum volume. Accordingly the friction torque and the torque fluctuations become smaller, as compared to the case when cranking is started in a state in which a cylinder volume is at its maximum volume. Due to this, it is possible to suppress vibration generated during restarting in reduced-cylinder operation. It should be understood that, since the idling cylinders are not perfectly sealed, accordingly, when the internal combustion engine is stopped during reduced-cylinder operation, the pressure within the idling cylinders changes to atmospheric pressure unless the time interval until the engine is restarted is extremely short.

In a control apparatus according to an aspect of the present invention, with this internal combustion engine, during reduced-cylinder operation, piston positions may be the same for the idling cylinders and for working cylinders; and the crank angle control device may control the initial crank angle so that, when cranking starts, piston positions of the working cylinders reach bottom dead center through their intake stroke after piston positions of the idling cylinders have first arrived at top dead center. The timing at which torque fluctuations of the working cylinders become greatest is the compression stroke after it passes intake bottom dead center. Thus, according to this aspect of the present invention, the timing at which torque fluctuations for the working cylinder become great is delayed, as compared to the case when, after cranking has started, the timing at which the piston positions of the idling cylinders first arrive at top dead center and the timing at which torque fluctuations for the working cylinders become great agree with one another. Thus, since it is possible to lengthen the interval from cranking starts until the resonance zone is passed through, accordingly it is possible to reduce the torque that is required until the resonance zone is passed through.

In a control apparatus according to another aspect of the present invention, with the internal combustion engine, during the reduced-cylinder operation, the piston positions of the idling cylinders and the working cylinders may be different; and the crank angle control device may control the initial crank angle so that the piston position of the working cylinder so that piston positions of the working cylinders are vicinity of their bottom dead center. According to this aspect of the present invention, the piston of the idling cylinder becomes positioned at a position removed from its bottom dead center due to the initial crank angle being controlled so that the piston positions of the working cylinders become in the vicinity of its bottom dead center, since the piston positions of the idling cylinders and the working cylinders are different from one another. Due to this, the cylinder volume of the idling cylinder becomes smaller than its maximum volume.

In a control apparatus according to another aspect of the present invention, there may further be included a valve control device configured to, after the cranking starts, implement at least one time intake stroke for the idling cylinders by opening and closing the intake valve of the idling cylinders. According to this aspect of the present invention, by implementing intake stroke for the idling cylinders after cranking has started, a change is made from a negative pressure cycle in which expansion from atmospheric pressure and subsequent compression are repeated to a positive pressure cycle in which compression from atmospheric pressure and subsequent expansion are repeated. Since, due to this, it is possible to maintain positive pressure in the idling cylinders after the internal combustion engine is restarted, accordingly it is possible to prevent oil from being sucked into the idling cylinders.

In a control apparatus according to another aspect of the present invention, there may further be included a valve control device configured to, during the stopping process of the internal combustion engine, implement at least one time exhaust stroke for the idling cylinders by opening and closing the exhaust valve of the idling cylinders. According to this aspect of the present invention, by implementing exhaust stroke for the idling cylinders during the process of stopping the internal combustion engine, a change is made from a positive pressure cycle in which compression from atmospheric pressure and subsequent expansion are repeated to a negative pressure cycle in which expansion from atmospheric pressure and subsequent compression are repeated. Due to this, the change of the frictional torque when the piston position of the idling cylinder is at a position removed from its bottom dead center becomes lower than in the case of the positive pressure cycle. Accordingly, control for stopping the position of the piston of the idling cylinder at a position removed from its bottom dead center becomes easy.

In this aspect of the present invention, the valve control device may implement at least one time exhaust stroke for the idling cylinders after fuel injection has stopped. If an exhaust stroke is implemented before fuel injection has stopped, then exhaust that is discharged from the working cylinders after combustion and air that is discharged from the idling cylinders mix together so that the density of oxygen in the exhaust increases, and there is a possibility that purification by an exhaust purification catalyst may not function effectively. Accordingly, by implementing the exhaust stroke for the idling cylinders after fuel injection has stopped, it is possible to avoid this type of problem.

In the present invention, the expression "vicinity of the top dead center" means a range of piston positions near a top dead center side including the top dead center, and similarly the expression "vicinity of the bottom dead center" means a range of piston positions near a bottom dead center side including the bottom dead center.

DESCRIPTION OF EMBODIMENTS

Embodiment #1

Figure 1:
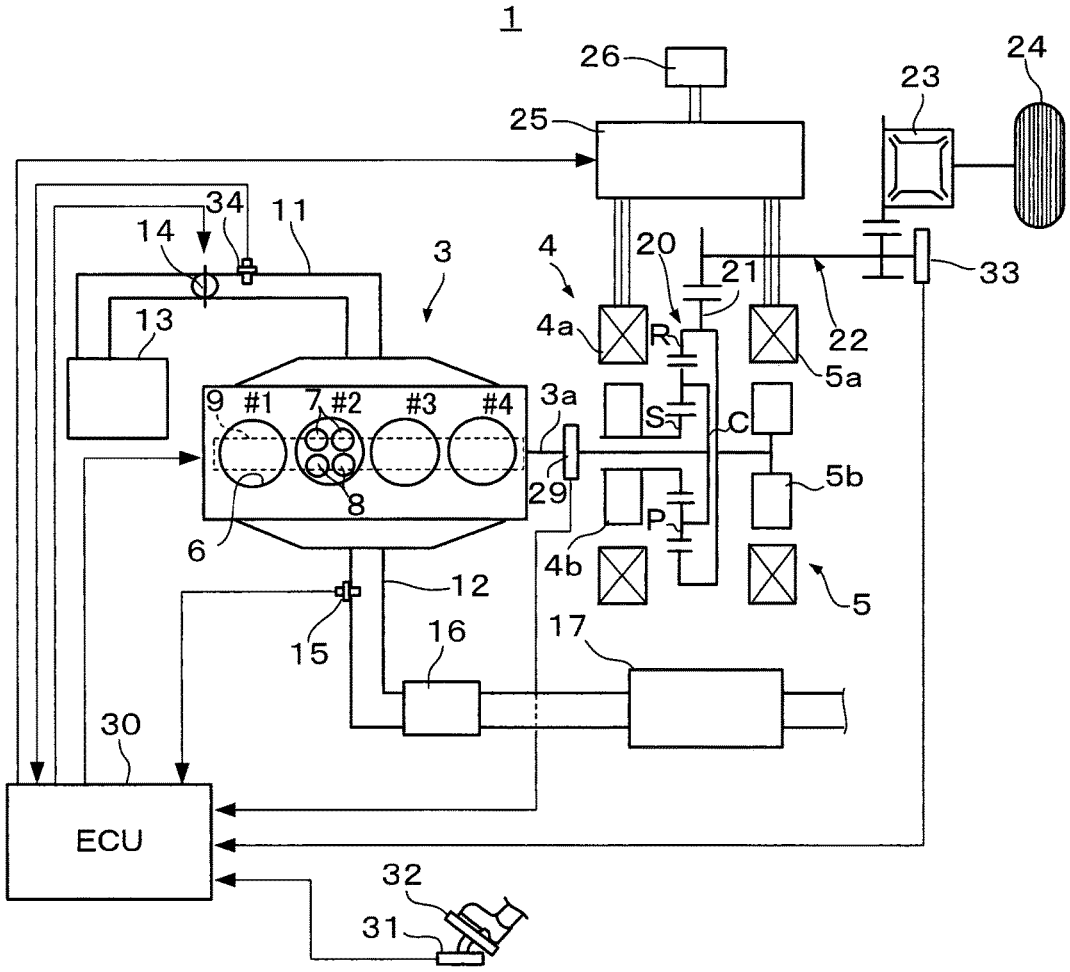
FIG. 1 is a figure showing the overall structure of a vehicle including an internal combustion engine to which a control apparatus according to an embodiment of the present invention has been applied.

As shown in FIG. 1, a vehicle 1 is built as a hybrid vehicle in which a plurality of power sources are combined. As power sources for propulsion, the vehicle 1 comprises an internal combustion engine 3 and two motor-generators 4 and 5. The internal combustion engine 3 is a four cylinder in-line spark ignition type internal combustion engine having four cylinders 6. As is general for a four cylinder in-line type internal combustion engine, ignition for the internal combustion engine 3 is implemented in the order: cylinder #1; cylinder #3; cylinder #4; cylinder #2. Each of the cylinders 6 is provided with two intake valves 7 and two exhaust valves 8, and these valves 7 and 8 are operated by a valve gear 9. The valve gear 9 has a cylinder idling function. According to operation of the valve gear 9, either reduced-cylinder operation in which, among the four cylinders 6, cylinder #1 and cylinder #4 are idled while the remaining cylinder #2 and cylinder #3 are operated, or all-cylinder operation in which all of the four cylinders 6 are operated, can be implemented for this internal combustion engine 3. When reduced-cylinder operation is implemented, the valve gear 9 stops each of the intake valves 7 and the exhaust valves 8 that are provided to cylinder #1 and to cylinder #4 in the closed state, these being the cylinders that are to be idled. Since a mechanical structure for the valve gear 9 to implement this type of function is per se known, detailed explanation thereof will be omitted. An intake passage 11 and an exhaust passage 12 are connected to each of the cylinders 6. An air cleaner 13 for filtering the intake air and a throttle valve 14 that is capable of adjusting the air flow amount are provided to the intake passage 11. An A/F sensor 15 that outputs a signal corresponding to the air/fuel ratio (A/F) of the internal combustion engine 3 is provided in the exhaust passage 12. Moreover, a three-way catalyst 16 and a NOx catalyst 17 that purify harmful components in the exhaust gases are provided in the exhaust passage 12.

The internal combustion engine 3 and the first motor-generator 4 are connected to a power split mechanism 20. The output of the power split mechanism 20 is transmitted to an output gear 21. The output gear 21 and the second motor-generator 5 are linked together and rotate as one unit. The power outputted from the output gear 21 is transmitted to a drive wheel 24 via a deceleration device 22 and a differential device 23. The first motor-generator 4 comprises a stator 4*a* and a rotor 4*b*. Along with functioning as a generator that receives power from the internal combustion engine 3 split off by the power split mechanism 20 and generates electricity therefrom, this first motor-generator 4 also functions as an electric motor that is driven by AC electrical power. In a similar manner, the second motor-generator 5 comprises a stator 5*a* and a rotor 5*b*, and functions both as an electric motor and a generator. Each of these motor-generators 4 and 5 is connected to a battery 26 via a motor control device 25. Along with converting electrical power generated by the motor-generators 4 and 5 into DC electricity which is stored in the battery 26, the motor control device 25 also converts electrical power from the battery 26 into AC power which is supplied to the motor-generators 4 and 5. The internal combustion engine 3 can be cranked and started by the first motor-generator 4 being driven; the details thereof will be described hereinafter. Moreover, an initial crank angle when cranking is started can be controlled by appropriately controlling the motor-generator 4. Accordingly, the first motor-generator 4 functions as the "electric motor" of the Claims.

The power split mechanism 20 is built as a single pinion type planetary gear mechanism, and comprises a sun gear S, a ring gear R, and a planetary carrier C that supports a pinion P meshed with these gears S and R in a state in which it is capable both of rotating around its own axis and also revolving. The sun gear S is connected to the rotor 4*a* of the first motor-generator 4, and the ring gear R is connected to the output gear 21, while the planetary carrier C is connected to the crankshaft 3*a* of the internal combustion engine 3. A crank angle sensor 29 is provided to the crankshaft 3*a*, and outputs a signal corresponding to the crank angle thereof.

Control of the vehicle 1 is performed by an electronic control unit 30 (i.e. by an ECU). The ECU 30 performs control of various types for the internal combustion engine 3 and for the motor-generators 4 and 5. Along with the crank angle sensor 29 described above being electrically connected to the ECU 30, other sensors of various types such as an accelerator opening amount sensor 31 that outputs a signal corresponding to the amount by which an accelerator pedal 32 is stepped upon and a vehicle speed sensor 33 that outputs a signal corresponding to the vehicle speed and so on are also electrically connected thereto. In the following, the principal form of control performed by the ECU 30 in relation to the present invention will be explained. The ECU 30 controls the vehicle 1 while changing over between various modes, in order to optimize the system efficiency in relation to the amount of power requested by the driver. For example, in the low load region in which the thermal efficiency of the internal combustion engine 3 decreases, an EV mode is selected in which combustion by the internal combustion engine 3 is stopped and the second motor-generator 5 is driven. Moreover, if there would not be enough torque with only the internal combustion engine 3 being operated, then a hybrid mode is selected in which at least one of the first motor-generator 4 and the second motor-generator 5 is also employed as a source of power for propulsion, along with the internal combustion engine 3. When this hybrid mode is selected, the operation of the internal combustion engine 3 is changed over between reduced-cylinder operation and all-cylinder operation according to the requested power amount.

Figure 2:
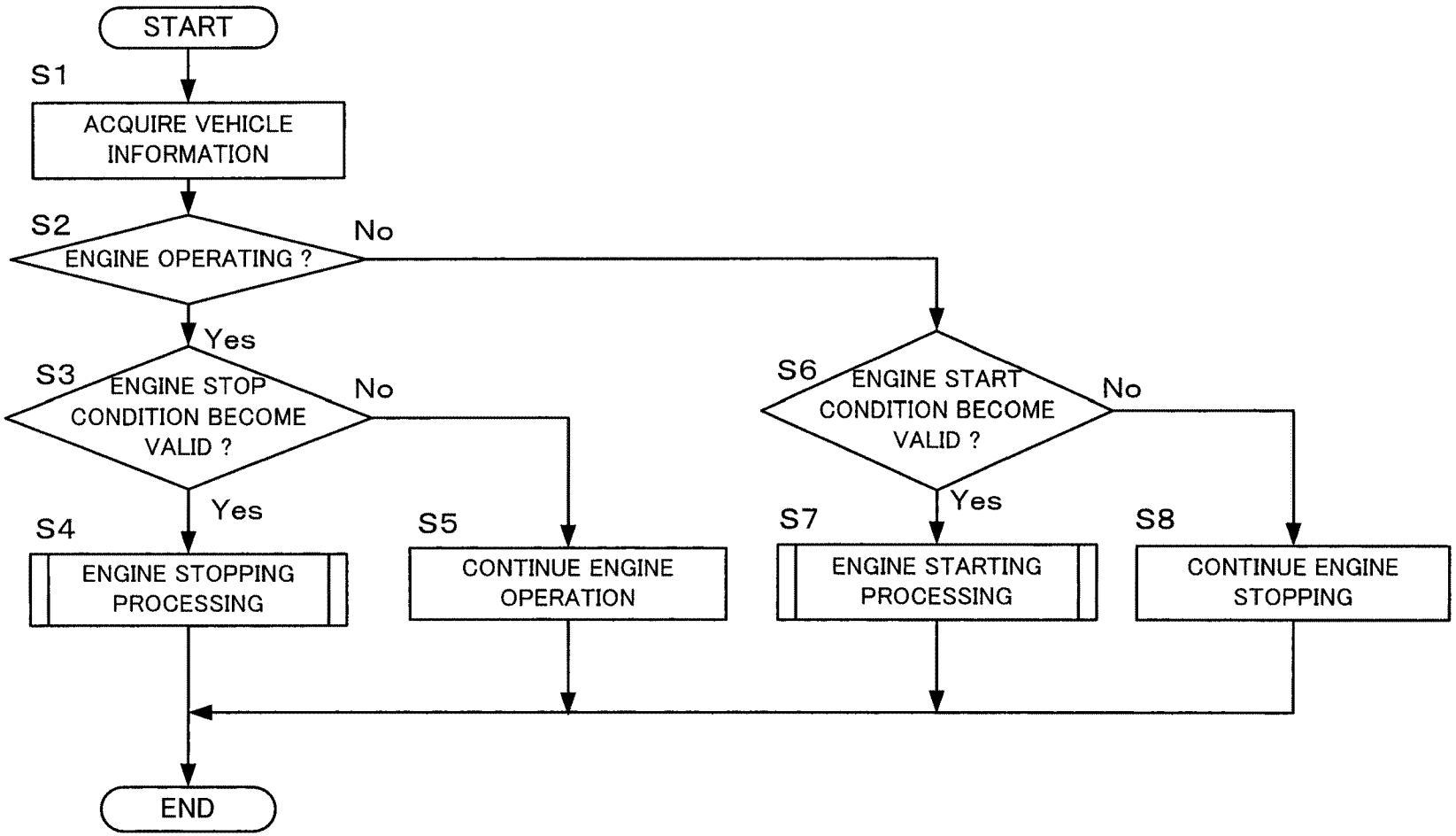
FIG. 2 is a flow chart showing an example of a control routine according to an embodiment of the present invention.
Figure 3:
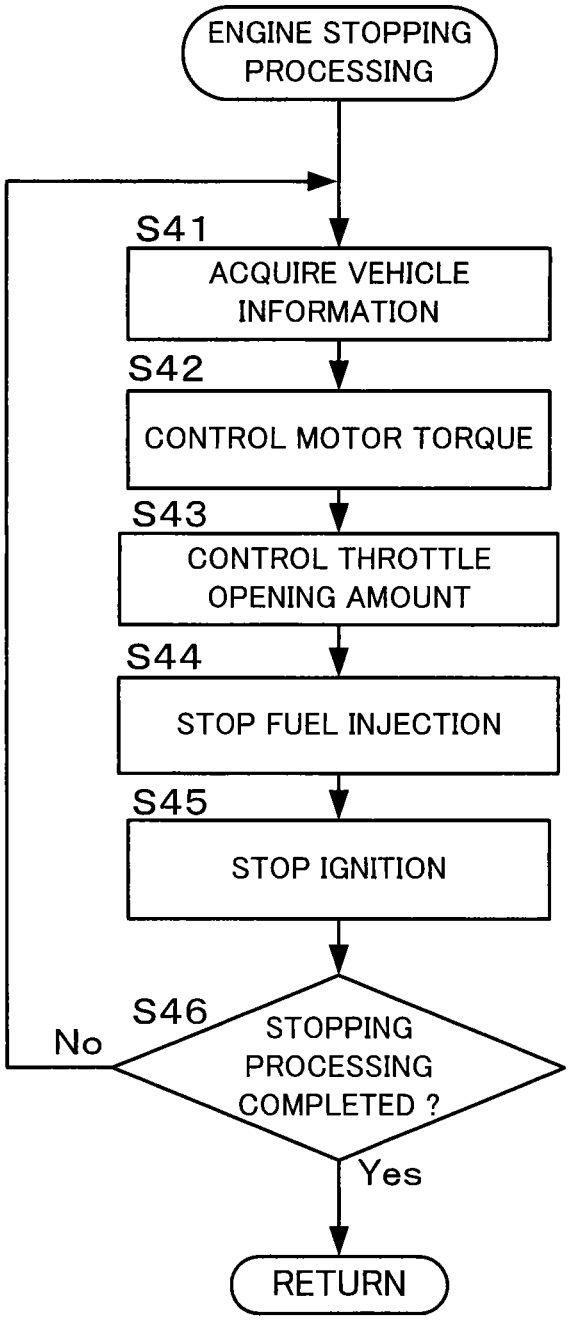
FIG. 3 is a flowchart showing an example of engine stopping processing defined by the control routine of FIG. 2.
Figure 4:
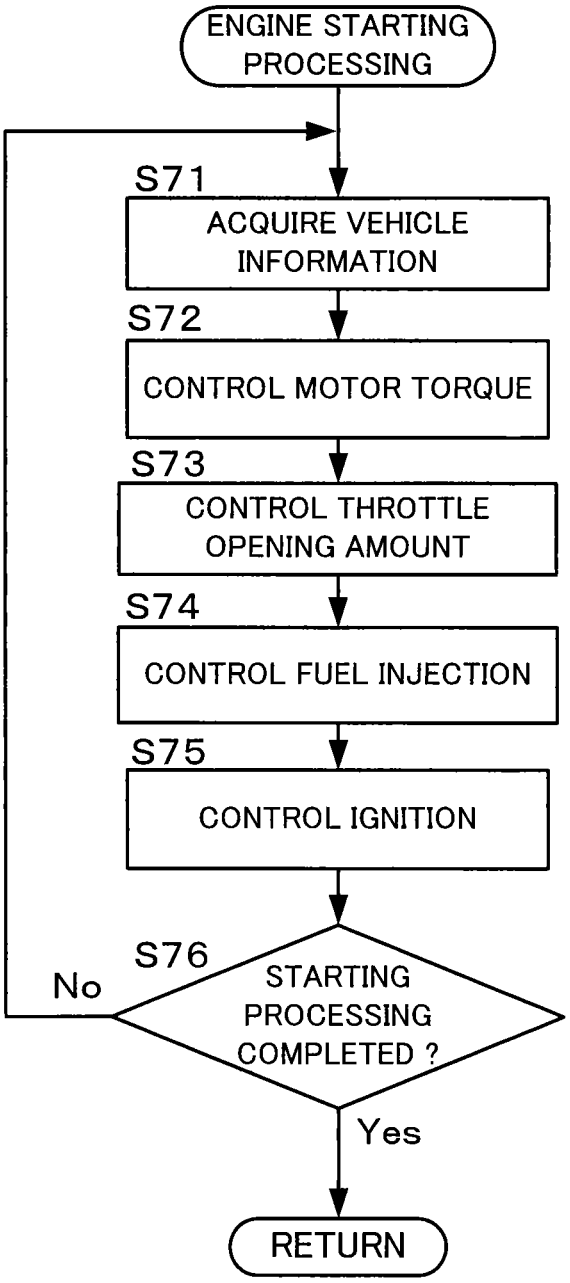
FIG. 4 is a flow chart showing an example of engine starting processing defined by the control routine of FIG. 2.

FIGS. 2 through 4 show examples of control routines executed by the ECU 30 in connection with the present invention. The control routine of FIG. 2 is a main routine, and a program for this routine is stored in the ECU 30 and is read out in a timely manner and repeatedly executed on a predetermined cycle. In a step S1, the ECU 30 acquires vehicle information. The vehicle speed, the accelerator opening amount, the battery remaining amount and so on are included in this vehicle information acquired by the ECU 30. It should be understood that the battery remaining amount is acquired on the basis of the output signal of a SOC sensor not shown in the figures. In a step S2, the ECU 30 makes a decision as to whether or not engine operation is taking place, in other words as to whether or not the internal combustion engine 3 is being operated. If the engine is being operated then the flow of control proceeds to a step S3, whereas if the engine is not operating, in other words during the EV mode, the flow of control is transferred to a step S6.

In the step S3, the ECU 30 makes a decision as to whether or not an engine stopping condition is valid. This engine stopping condition becomes valid when conditions are satisfied that are set for parameters of various sorts, such as the requested power and the battery remaining amount and so on. If the engine stopping condition has become valid, then the flow of control proceeds to a step S4 for stopping the operation of the internal combustion engine 3, and engine stopping processing that will be described hereinafter is performed. On the other hand, if the engine stopping condition has not become valid, then the flow of control proceeds to a step S5 and operation of the internal combustion engine 3 is continued. In other words, the hybrid mode is continued.

In the step S6, the ECU 30 makes a decision as to whether or not an engine starting condition holds. In a similar manner to the case for the engine stopping condition, this engine starting condition becomes valid when conditions are satisfied that are set for parameters of various sorts, such as the requested power and the battery remaining amount and so on. If the engine starting condition has become valid, then the flow of control proceeds to a step S7 for starting the internal combustion engine 3, and engine starting processing that will be described hereinafter is performed. On the other hand, if the engine starting condition has not become valid, then the flow of control proceeds to a step S8 and the stopped state of the internal combustion engine 3 is continued. In other words, the EV mode is continued.

The engine stopping processing is a process in which the crankshaft 3*a* of the internal combustion engine 3 is stopped at a desired crank angle by control of the first motor-generator 4, so that the initial crank angle when cranking is later performed for restarting is controlled. Various propositions have been made in the prior art for performing this type of engine stopping processing; for example, the control routine shown in FIG. 3 may be implemented. A program for this routine is stored in the ECU 30 and is read out and executed when engine stopping processing is to be performed.

Figure 5:
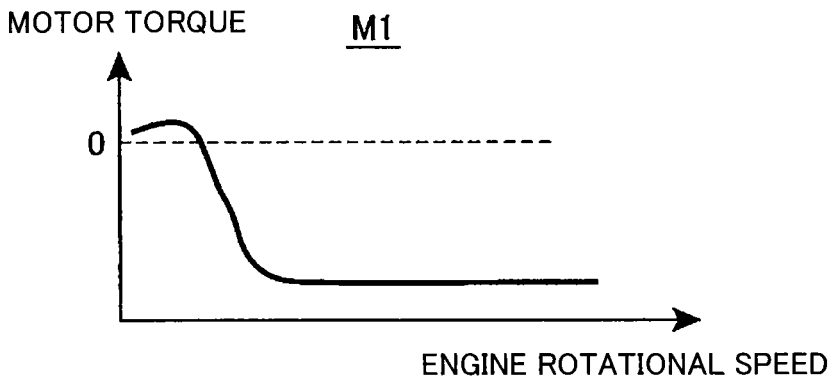
FIG. 5 is a figure showing an example of a calculation map that is referred to for calculating motor torque during engine stopping processing.

In a step S41, the ECU 30 acquires vehicle information such as the engine rotational speed and so on. In a step S42, the ECU 30 calculates the motor torque corresponding to the engine rotational speed, and controls the first motor-generator 4 by commanding the motor control device 25 to make it provide this motor torque. This calculation of the motor torque is implemented by referring to a calculation map M1 that contains a data structure like that shown in FIG. 5, and by specifying the motor torque corresponding to the current engine rotational speed. It should be understood that negative motor torque is torque in the direction from the internal combustion engine 3 toward the first motor-generator 4. To put it in another manner, negative motor torque is torque that acts in the sense to reduce the engine rotational speed.

Figure 6:
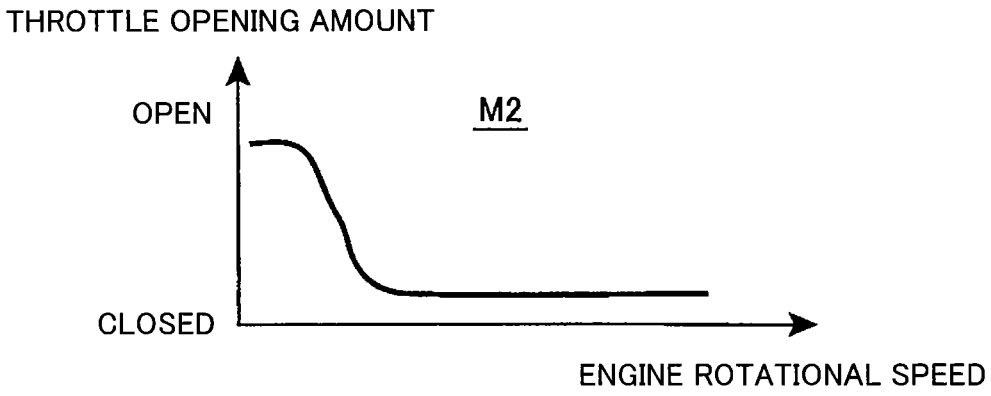
FIG. 6 is a figure showing an example of a calculation map that is referred to for calculating throttle opening amount during engine stopping processing.

In a step S43, the ECU 30 calculates the throttle opening amount corresponding to the engine rotational speed, and controls the throttle valve 14 so that it provides this throttle opening amount. This calculation of the throttle opening amount is implemented by referring to a calculation map M2 that contains a data structure like that shown in FIG. 6, and by specifying the throttle opening amount corresponding to the current engine rotational speed. In a step S44, the ECU 30 stops fuel injection for the internal combustion engine 3. In a step S45, the ECU 30 stops providing ignition for the internal combustion engine 3. Due to the processing of the steps S42 through S45 being implemented, the engine rotational speed gradually decreases, and finally the crankshaft 3*a* stops rotating.

In a step S46, the ECU 30 makes a decision as to whether or not the engine stopping processing has been completed with the piston position at which the crankshaft 3*a* has stopped being controlled to a predetermined position. If the stopping processing has not been completed, then the flow of control returns to the step S41, and the processing of the steps S41 through S45 is repeatedly executed until the stopping processing has been completed. Here, the piston positions when the crankshaft 3*a* stops are different for the case of reduced-cylinder operation and for the case of all-cylinder operation. In the case of reduced-cylinder operation, it is decided that the stopping processing has been completed if the positions of the pistons of the #1 cylinder and of the #4 cylinder when the crankshaft 3*a* stops are near their top dead centers, these being the idling cylinders. Since the phases of the idling cylinders and of the working cylinders are 180° apart, accordingly at this time the positions of the pistons of the working cylinders are near their bottom dead centers. On the other hand, in the case of all-cylinder operation, it is decided that the stopping control has been completed if the positions of the pistons of the #2 cylinder and of the #3 cylinder when the crankshaft 3*a* stops, these being working cylinders, are near their top dead centers. Since, when the internal combustion engine 3 is being restarted after engine stopping processing has been performed in this manner, the cranking is started in a state with the pistons positioned at predetermined positions, accordingly the crank angle in this state corresponds to the initial crank angle.

The engine starting processing is a process in which the internal combustion engine 3 is cranked and started by control of the first motor-generator 4; for example, the control routine shown in FIG. 4 may be implemented. A program for this routine is stored in the ECU 30 and is read out and executed when engine starting processing is to be performed.

Figure 7:
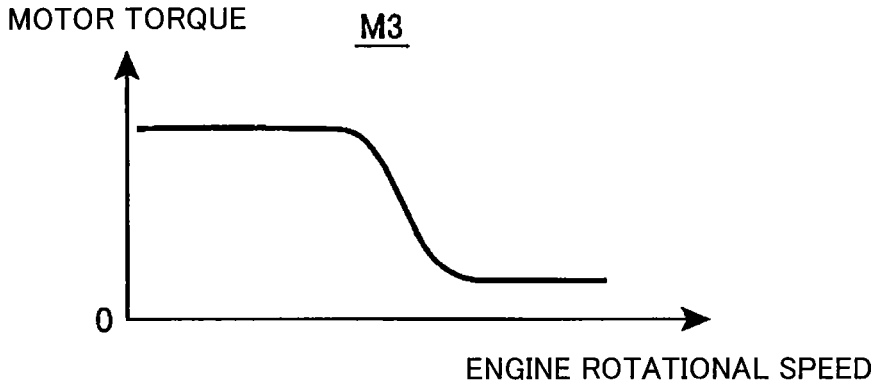
FIG. 7 is a figure showing an example of a calculation map that is referred to for calculating motor torque during engine starting processing.

In a step S71, the ECU 30 acquires vehicle information. The vehicle information that is acquired here is the engine rotational speed and the ambient atmospheric pressure. It should be understood that the atmospheric pressure is acquired on the basis of the output signal of a pressure sensor not shown in the figures. In a step S27, the ECU 30 calculates a motor torque that corresponds to this engine rotational speed, and controls the first motor-generator 4 by commanding the motor control device 25 to cause it to provide this motor torque. This calculation of the motor torque is implemented by referring to a calculation map M3 that contains a data structure like that shown in FIG. 7, and by specifying the motor torque corresponding to the current engine rotational speed.

Figure 8:
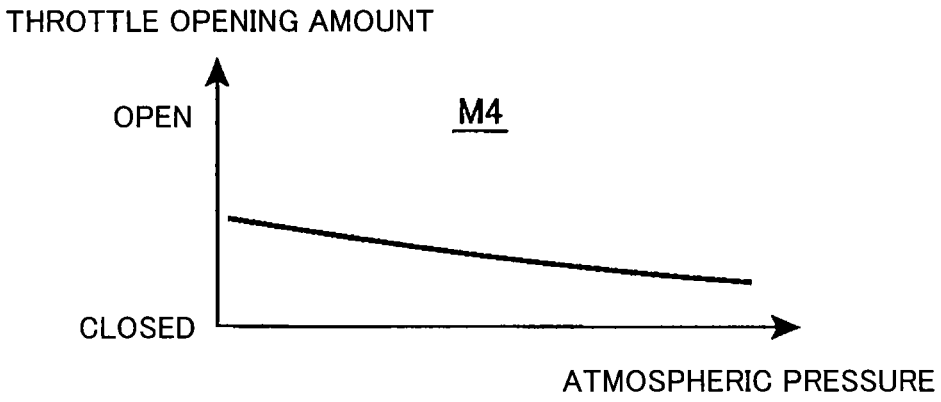
FIG. 8 is a figure showing an example of a calculation map that is referred to for calculating throttle opening amount during engine starting processing.
Figure 9:
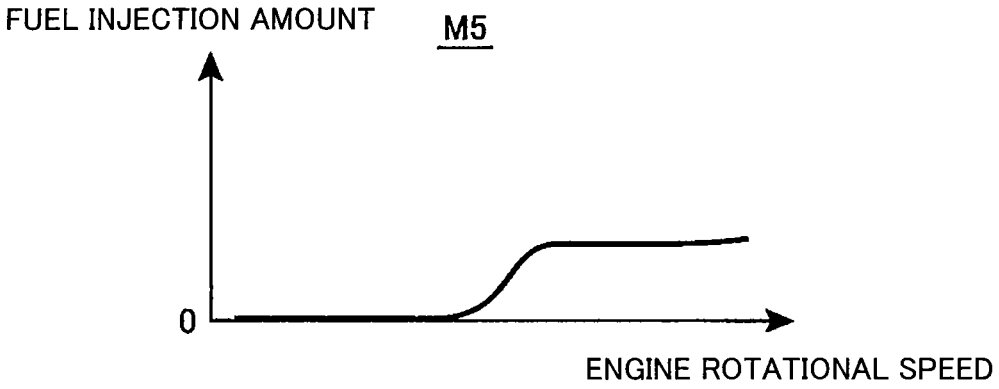
FIG. 9 is a figure showing an example of a calculation map that is referred to for calculating fuel injection amount during engine starting processing.
Figure 10:
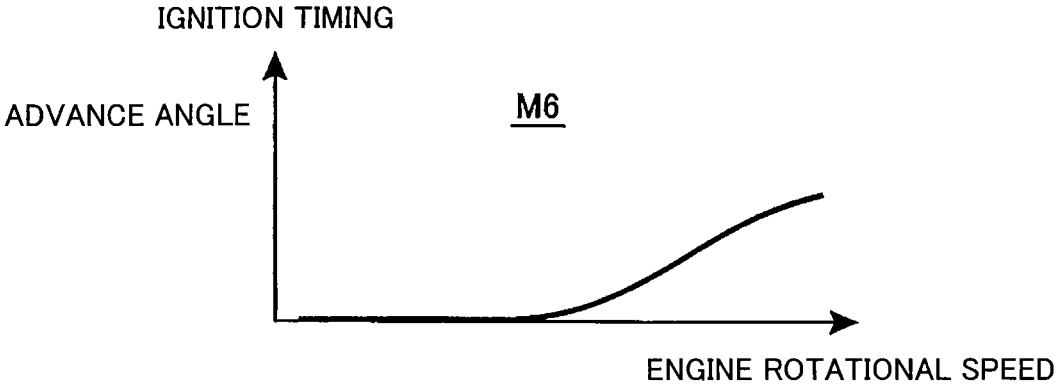
FIG. 10 is a figure showing an example of a calculation map that is referred to for calculating ignition timing during engine starting processing.

In a step S73, the ECU 30 calculates a throttle opening amount corresponding to the atmospheric pressure, and controls the throttle valve 14 so that it provides this throttle opening amount. This calculation of the throttle opening amount is implemented by referring to a calculation map M4 that contains a data structure like that shown in FIG. 8, and by specifying the throttle opening amount corresponding to the current atmospheric pressure. In a step S74, the ECU 30 calculates a fuel injection amount corresponding to the engine rotational speed, and controls the internal combustion engine 3 so that this fuel injection amount of fuel is injected. This calculation of the fuel injection amount is implemented by referring to a calculation map M5 that contains a data structure like that shown in FIG. 9, and by specifying the fuel injection amount corresponding to the current engine rotational speed. In a step S75, the ECU 30 calculates an ignition timing corresponding to the engine rotational speed, and controls the internal combustion engine 3 so that ignition is performed according to this ignition timing. This calculation of the ignition timing is implemented by referring to a calculation map M6 that contains a data structure like that shown in FIG. 10, and by specifying the ignition timing corresponding to the current engine rotational speed.

In a step S76, the ECU 30 decides whether or not the starting processing has been completed, and if the starting processing has not been completed, then the flow of control returns to the step S71, and the processing of the steps S71 through S75 is repeatedly executed until the starting processing has been completed. Whether or not the starting processing has been completed is determined according to whether or not the engine rotational speed has arrived at a decision threshold value at which autonomous engine operation becomes possible.

Figure 11:
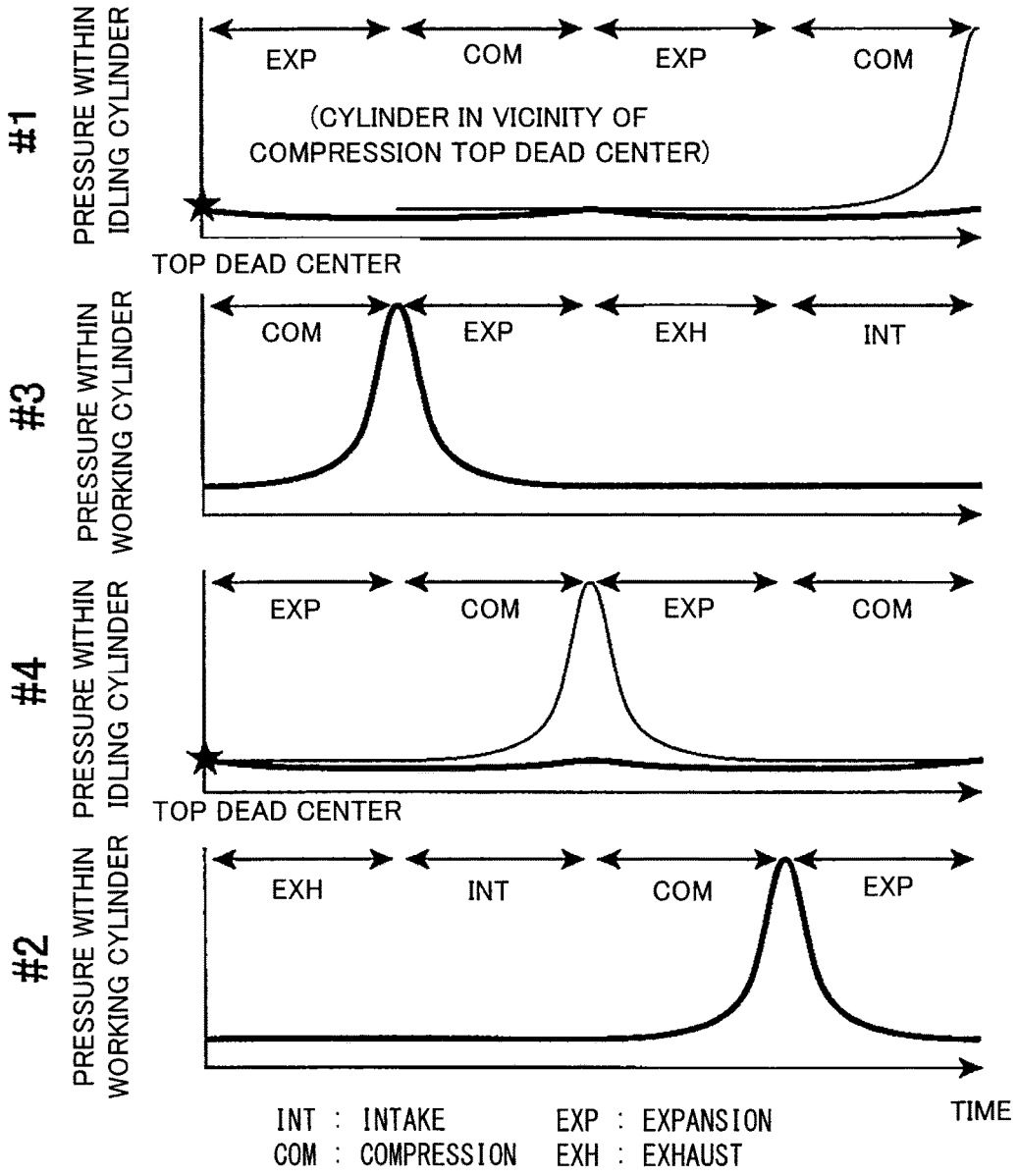
FIG. 11 is a figure showing changes over time of the cylinder internal pressures, during cranking when restarting.
Figure 12:
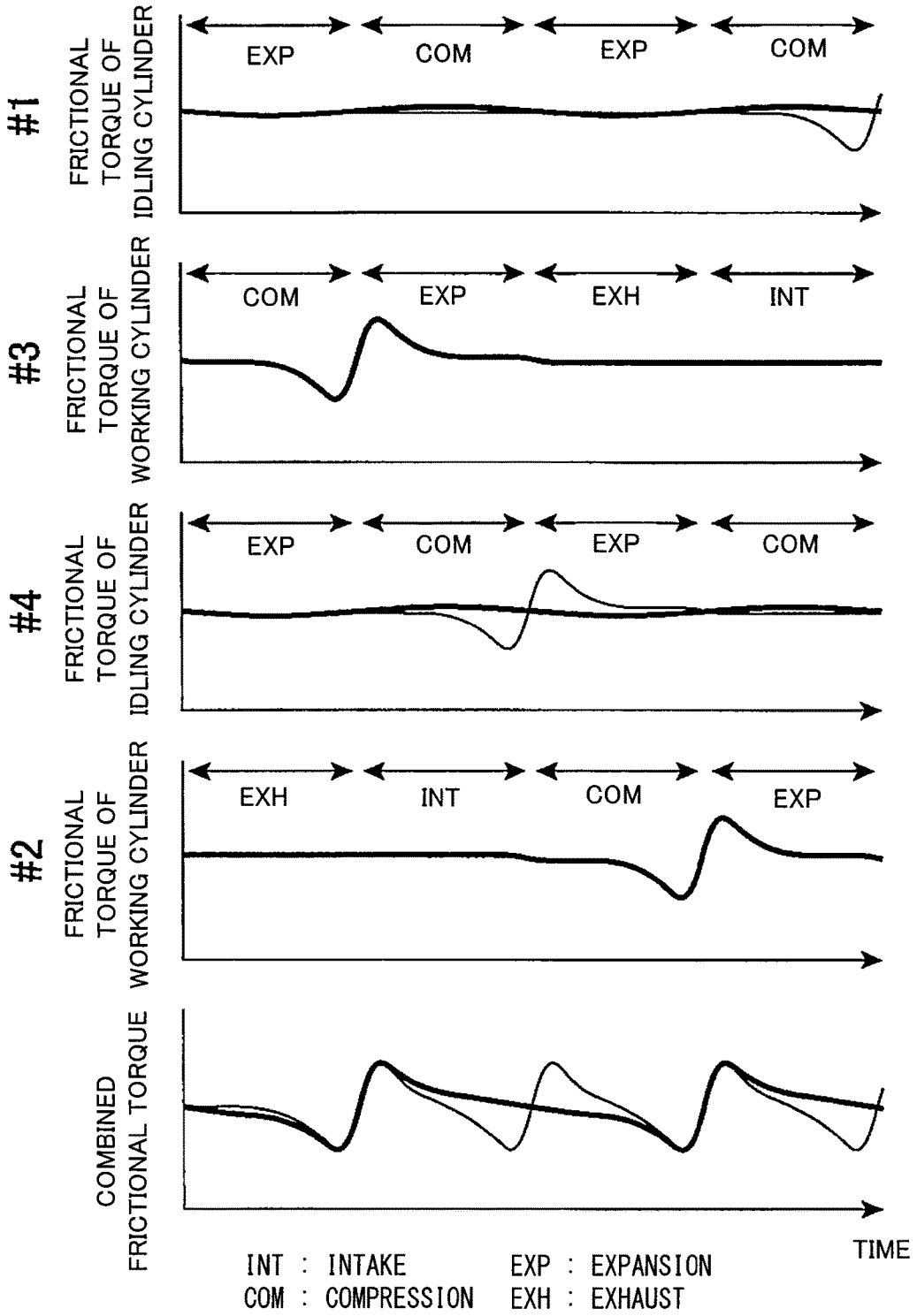
FIG. 12 is a figure showing changes over time of the frictional torques, during cranking when restarting.
Figure 13:
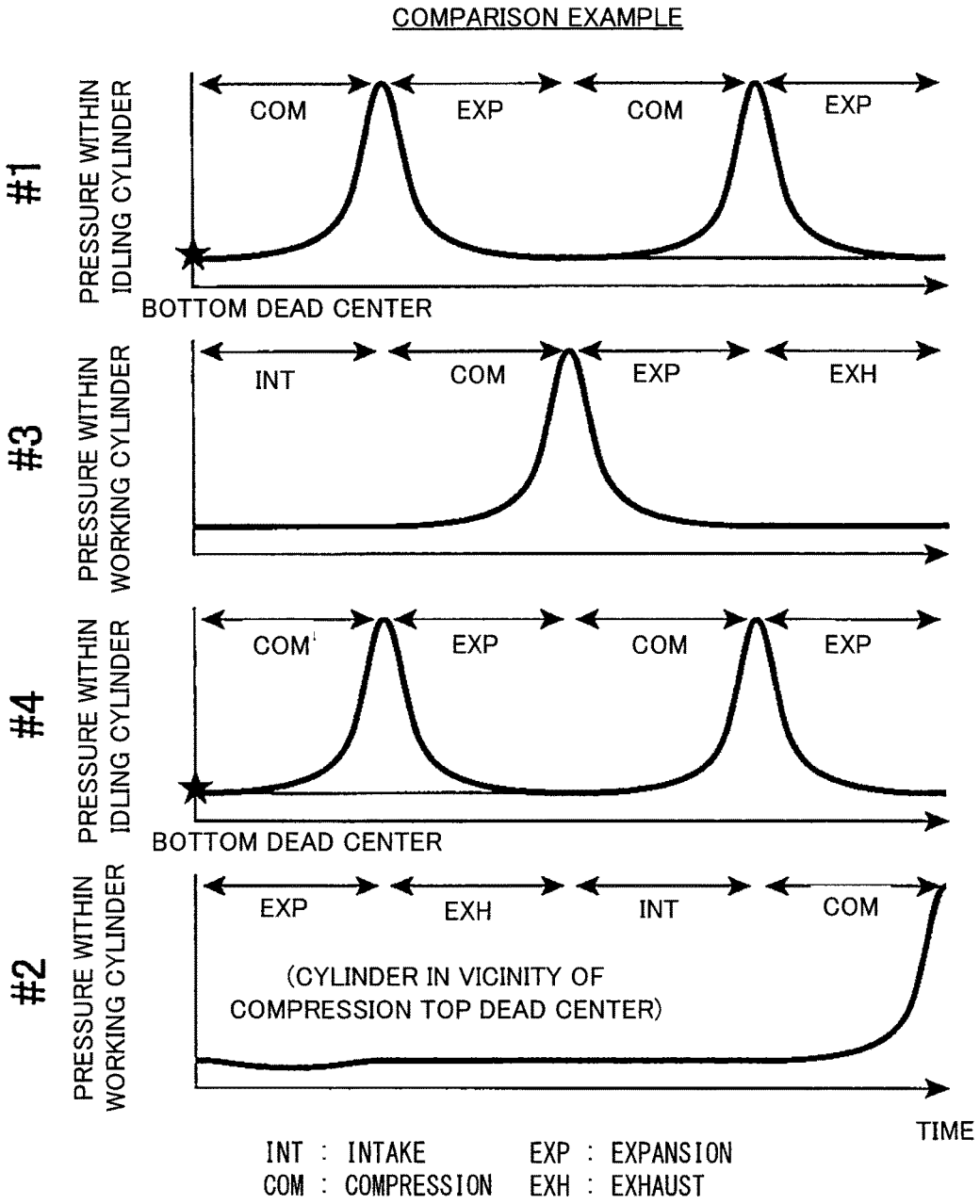
FIG. 13 is a figure showing changes over time of the cylinder internal pressures, according to a comparison example.
Figure 14:
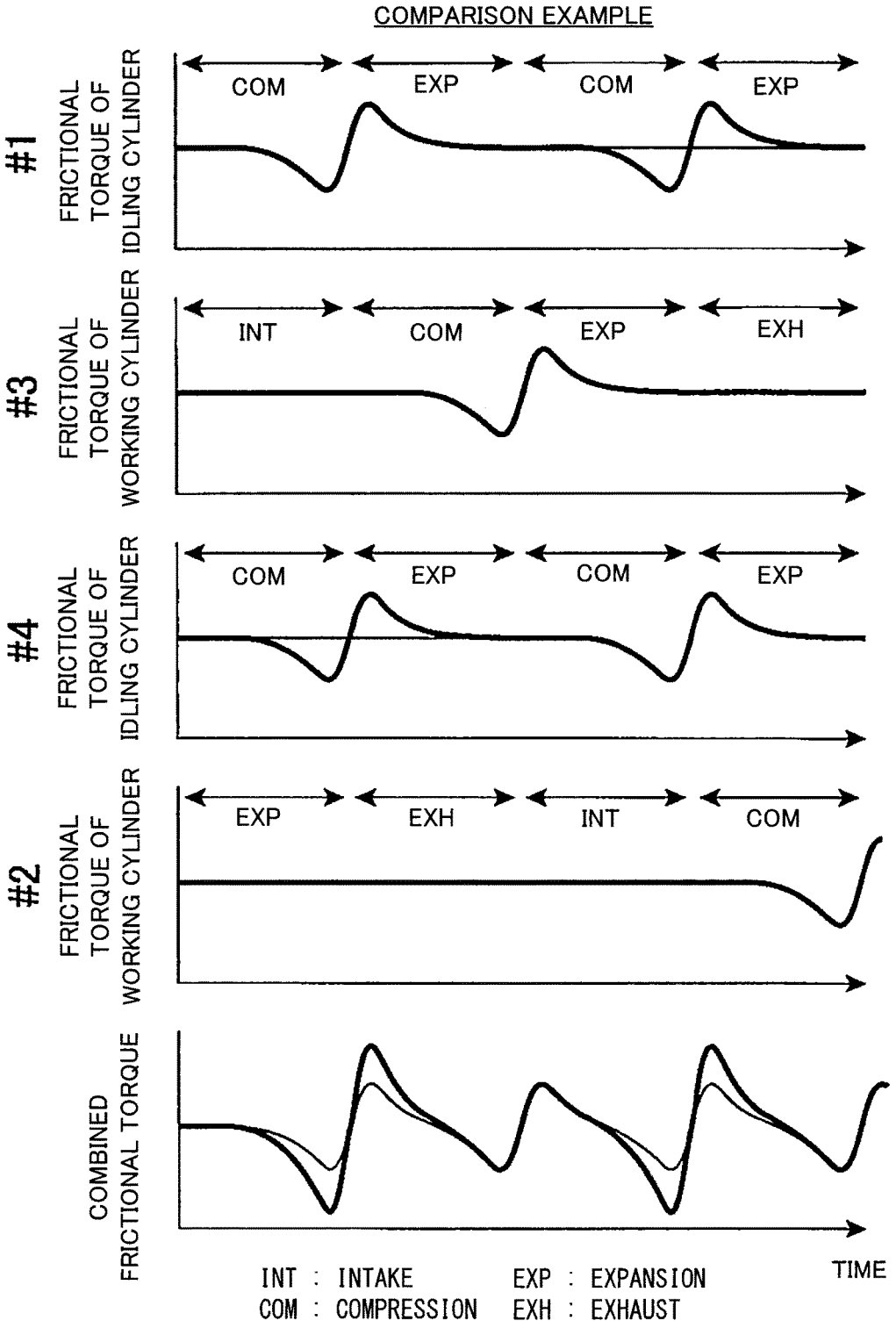
FIG. 14 is a figure showing changes over time of the frictional torques, according to the comparison example.

By the ECU 30 executing the control of FIGS. 2 through 4 described above, the ECU 30 functions as the "crank angle control device" of the Claims, and the beneficial effects described below can be obtained. When the internal combustion engine 3 stops during reduced-cylinder operation and then is restarted in reduced-cylinder operation, the changes over time during cranking of the pressure in each of the cylinders 6 and of the frictional torque of each of the cylinders 6 are shown in FIGS. 11 and 12 respectively. Moreover, the thin line curves in FIGS. 13 and 14 show the pressures within the cylinders and the frictional torques for the case of starting in all-cylinder operation. As described above, the engine stopping processing controls the positions of the pistons of the idling cylinders to the vicinity of their top dead centers. Accordingly, as shown in FIG. 11, the fluctuations of the internal cylinder pressures of the idling cylinders are relatively small, and moreover, as shown in FIG. 12, the fluctuations of the frictional torques of the idling cylinders are also relatively small. Furthermore, as shown in FIG. 12, for the combined frictional torque, when the frictional torque of the cylinders 6 is compared with the case of starting in all-cylinder operation, the peak value and the fluctuation range of the combined frictional torque are not changed.

By contrast, in the case of the comparison example shown in FIGS. 13 and 14, during engine stopping processing, the piston positions of the idling cylinders are controlled to be in the vicinity of their bottom dead centers. Since, due to this, cranking is started in the state with the volumes within the idling cylinders being large, accordingly during starting both the pressures within the idling cylinders and also their frictional torques are relatively large. And, as shown in FIG. 14, for the combined frictional torque, when a comparison is made with the case of starting in all-cylinder operation, the peak value of the combined frictional torque becomes relatively great and its fluctuation range also becomes relatively great.

Since in this manner, according to the control of this embodiment, both the peak value of the combined frictional torque and also the range over which it fluctuates become smaller as compared with the comparison example, accordingly it is possible to suppress the generation of vibration during restarting in reduced-cylinder operation.

Embodiment #2

Figure 15:
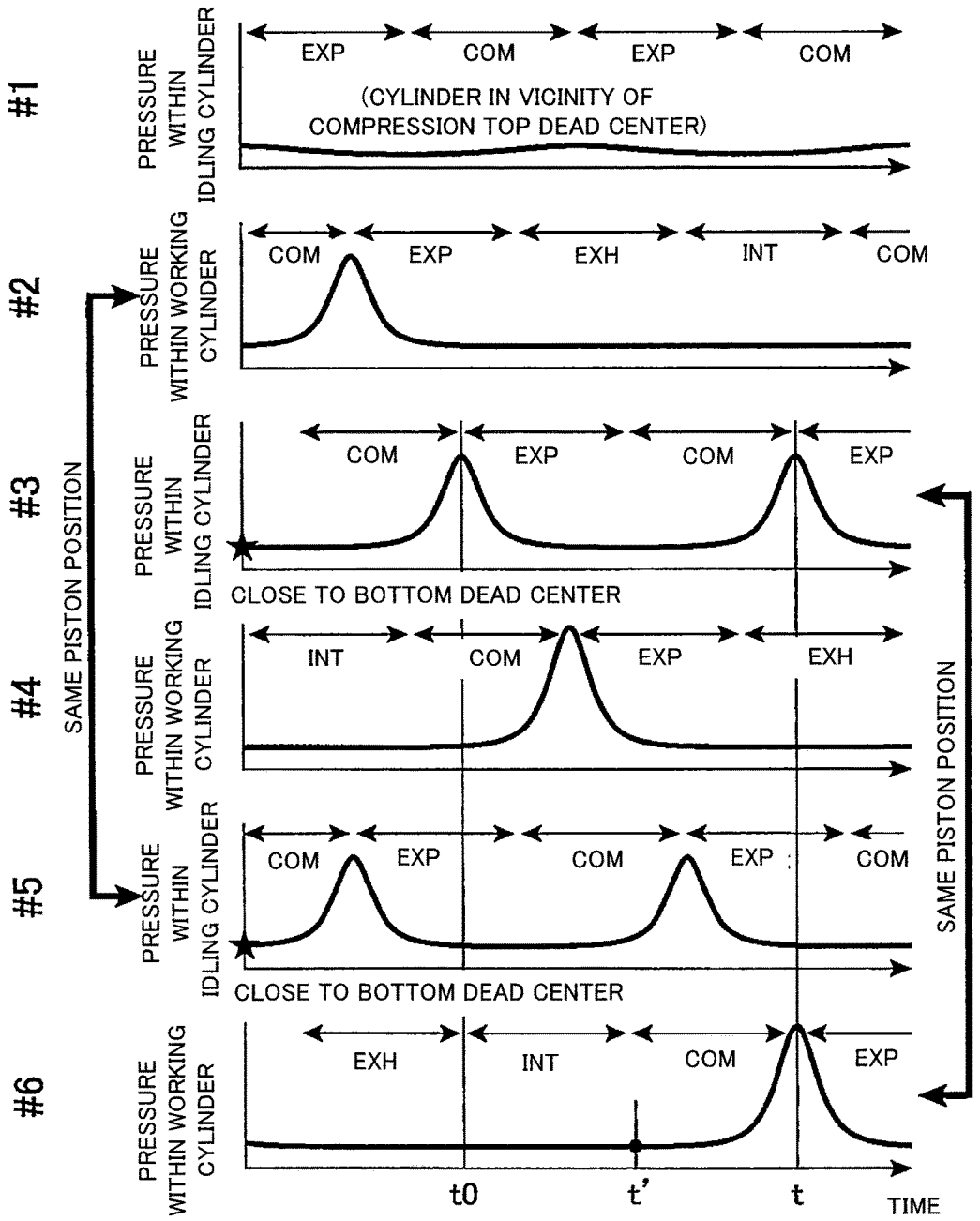
FIG. 15 is a figure showing changes over time of the cylinder internal pressures, according to a second embodiment.
Figure 16:
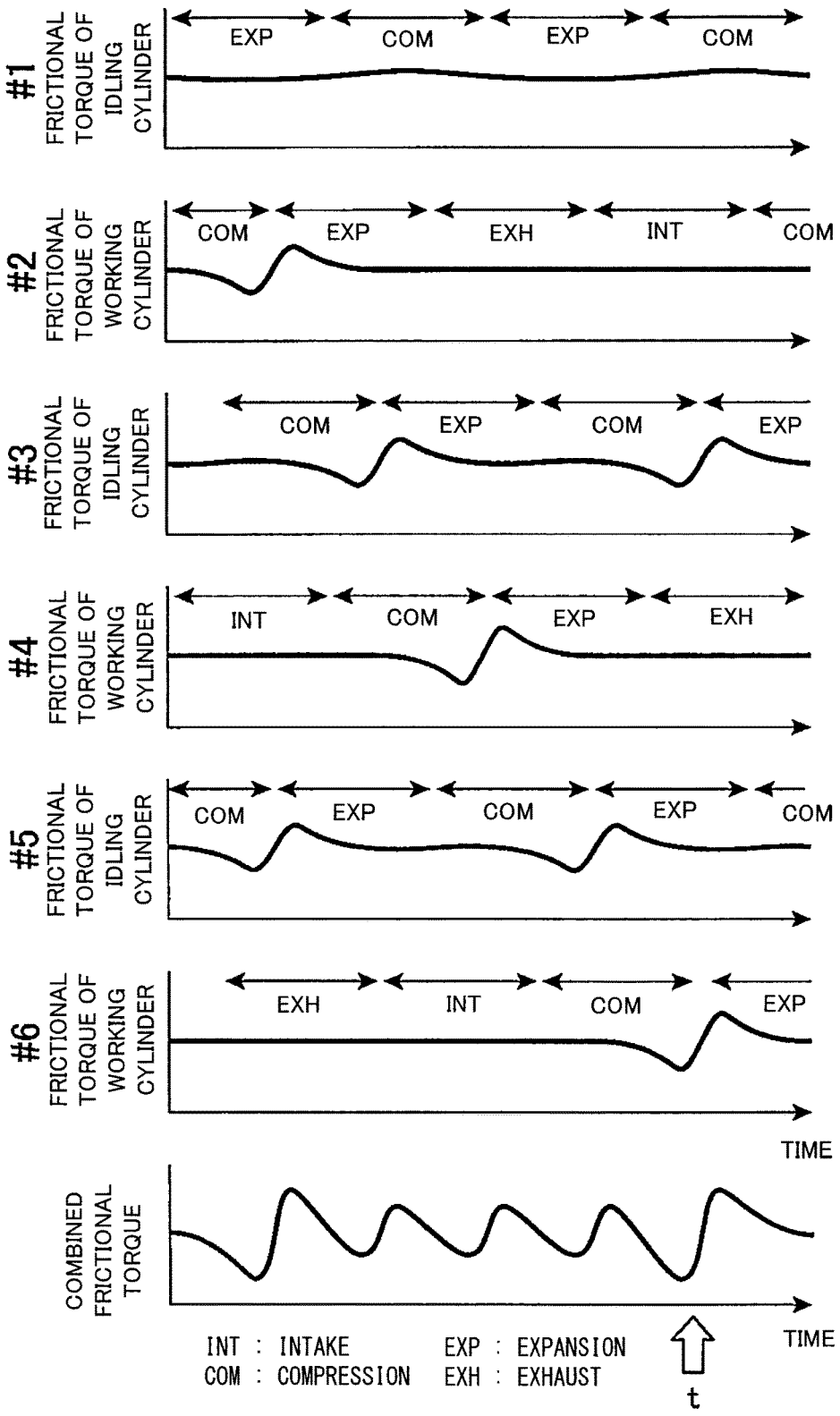
FIG. 16 is a figure showing changes over time of the frictional torques, according to the second embodiment.

Next a second embodiment of the present invention will be explained with reference to FIGS. 15 through 18. This second embodiment is one in which the present invention is applied to a V-type six cylinder internal combustion engine having a bank angle of 60°. Ignition for this internal combustion engine is implemented in the order: cylinder #1; cylinder #2; cylinder #3; cylinder #4; cylinder #5; cylinder #6. The other features are the same as in the first embodiment, and accordingly duplicated explanation will be omitted. The internal combustion engine according to this second embodiment is capable of implementing both reduced-cylinder operation and also all-cylinder operation, and, during reduced-cylinder operation, the piston positions are the same between the idling cylinders and the working cylinders. In other words, as shown in FIG. 15, during reduced-cylinder operation, cylinder #1, cylinder #3, and cylinder #5 are all idling cylinders, while the remainder of the cylinders are working cylinders. The idling cylinders and the working cylinders operate at piston positions. With the control of this second embodiment, the ECU 30 controls the initial crank angle so that the position of the piston of cylinder #1, which is an idling cylinder, comes to be in the vicinity of its compression top dead center. Due to this, while the positions of the pistons of cylinder #3 and of cylinder #5, which are idling cylinders, are close to their bottom dead centers, they are not exactly at bottom dead center. Accordingly, the cylinder volumes of cylinder #3 and of cylinder #5, which are idling cylinders, are also smaller than their maximum volumes. Since, in this second embodiment, the initial crank angle is controlled so that the piston positions when stopped come to be in this type of state, accordingly, when restarting is performed in reduced cylinder operation, when cranking is started, after the position of the piston of #3 cylinder, which is an idling cylinder, has arrived at its top dead center, the position of the piston of #6 cylinder, which is the same piston position as that of #3 cylinder, arrives at its bottom dead center via its intake stroke. Due to this, the ECU 30 functions as the "crank angle control device" of the Claims.

Figure 17:
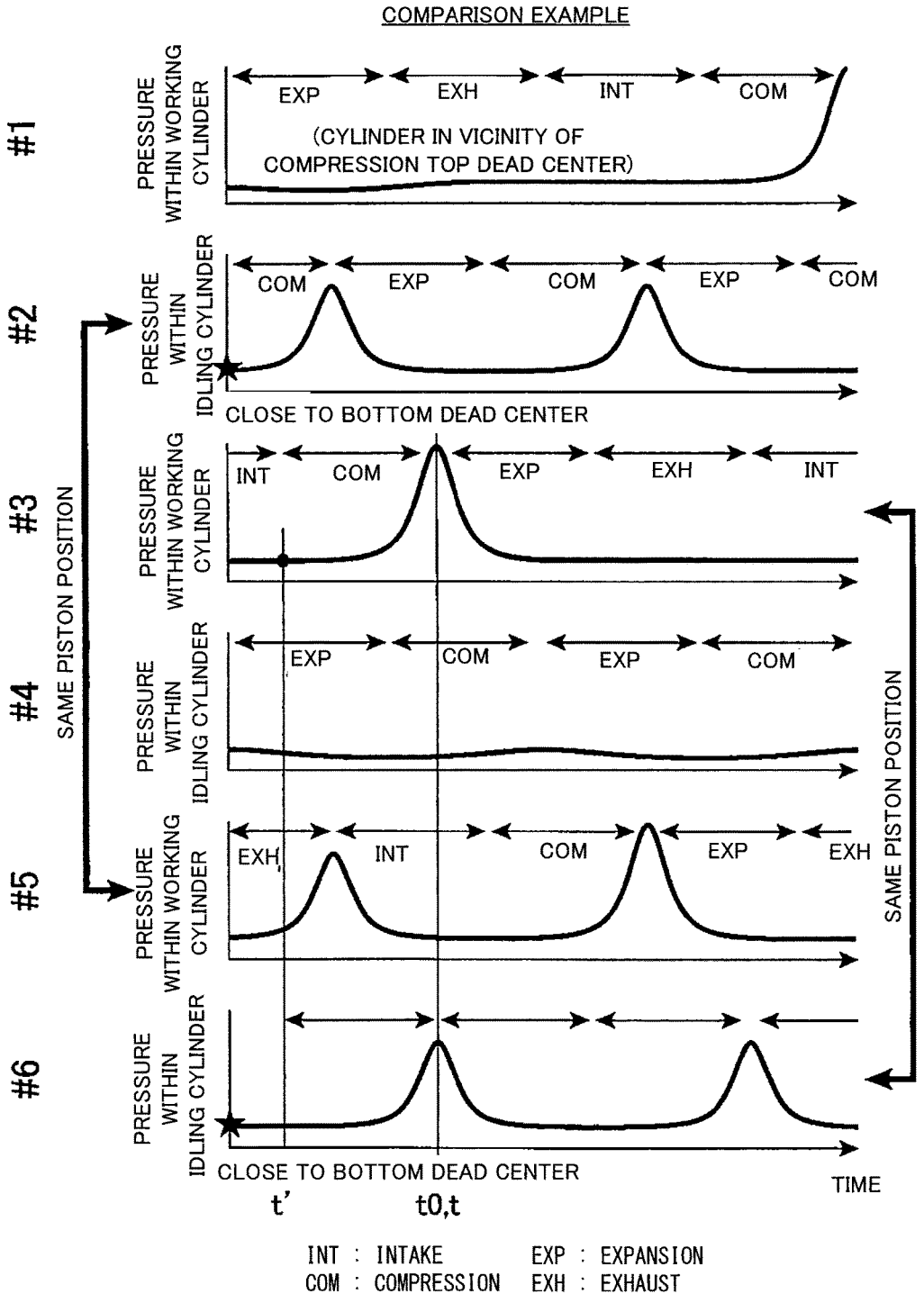
FIG. 17 is a figure showing changes over time of the cylinder internal pressures, according to a comparison example.
Figure 18:
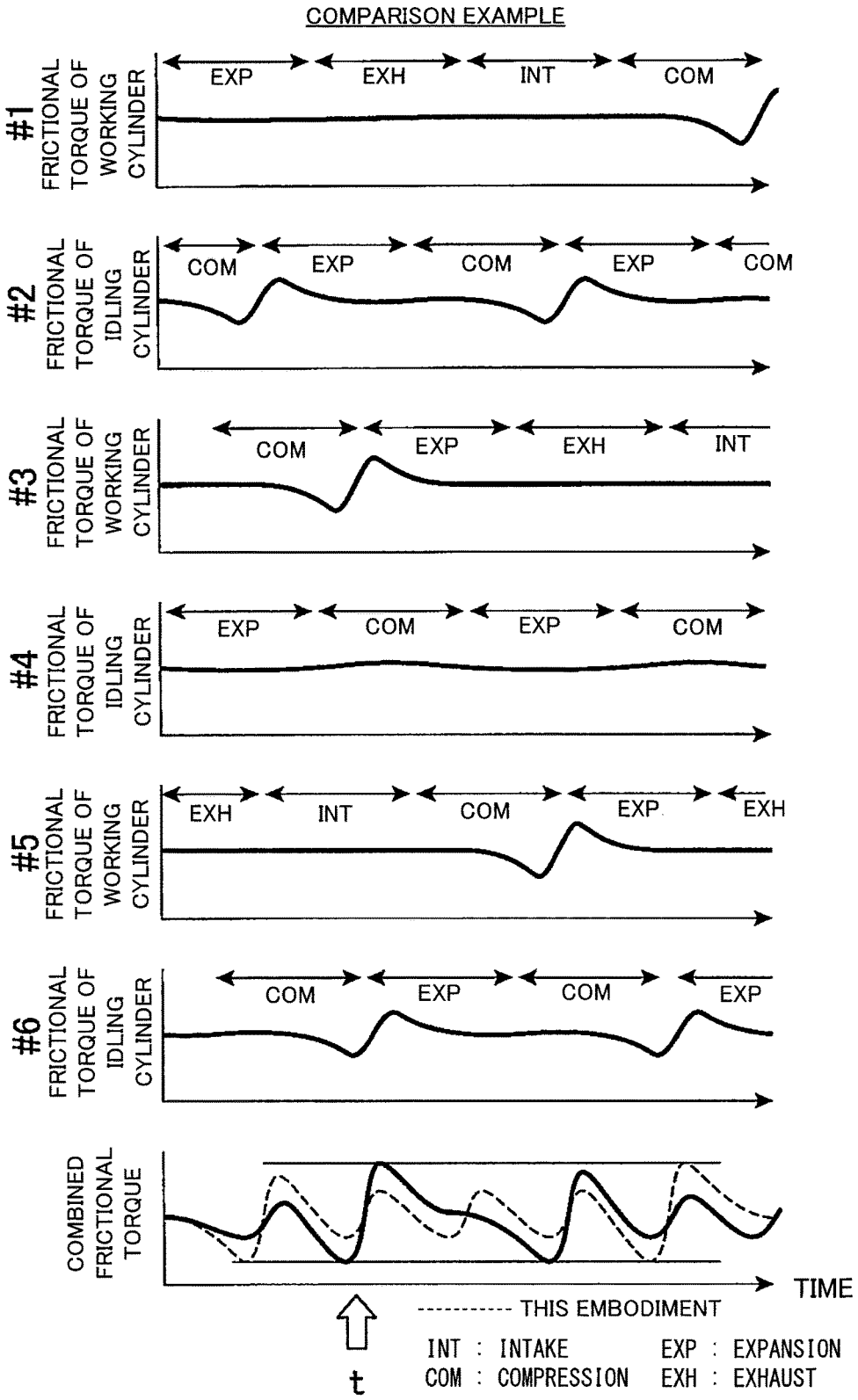
FIG. 18 is a figure showing changes over time of the frictional torques, according to the comparison example.

Due to the above, the timing t at which overlapping takes place between the timing at which cylinder #3, which is an idling cylinder, arrives at its top dead center and the timing at which cylinder #6, which is a working cylinder, arrives at its compression top dead center becomes one cycle after the timing t0 at which cylinder #3 first arrives at its top dead center. To put this in another manner, the timing t' at which cylinder #6, which is a working cylinder, arrives at its bottom dead center via its intake stroke becomes later than the timing t0 at which cylinder #3 first arrives at its top dead center. Accordingly, the timing t at which the timing at which the fluctuation of the combined frictional torque shown in FIG. 16 becomes great is delayed. By contrast, in the case of the comparison example shown in FIGS. 17 and 18, since the timing t0 when the idling cylinder first arrives at its top dead center and the timing t at which the working cylinder arrives at its compression top dead center overlap, accordingly the timing at which the fluctuation of the combined frictional torque shown in FIG. 18 becomes great is advanced. It should be understood that the comparison example shown in FIGS. 17 and 18 is a case in which, during reduced-cylinder operation, cylinder #2, cylinder #4, and cylinder #6 are idling cylinders, while the remaining cylinders are working cylinders.

According to this second embodiment, the timing at which the torque fluctuation of the working cylinders becomes great is delayed, as compared to the case in which, after the start of cranking, the timing at which the piston position of an idling cylinder first arrives at its top dead center and the timing at which the torque fluctuations of the working cylinders becomes great agree with one another.

Accordingly it is possible to reduce the torque required for passing through the resonance zone, since it is possible to lengthen the time interval from starting of cranking during restarting until passing through the resonance zone.

Embodiment #3

Next, a third embodiment of the present invention will be explained with reference to FIGS. 19 and 20. This third embodiment is distinguished by control that is implemented along with the control of the first embodiment. Namely, in the control of this third embodiment, after cranking during restarting of the internal combustion engine 3 is started, at least one intake stroke for at least one of the idling cylinders is implemented while opening and closing an intake valve 7 of the idling cylinder.

Figure 19:
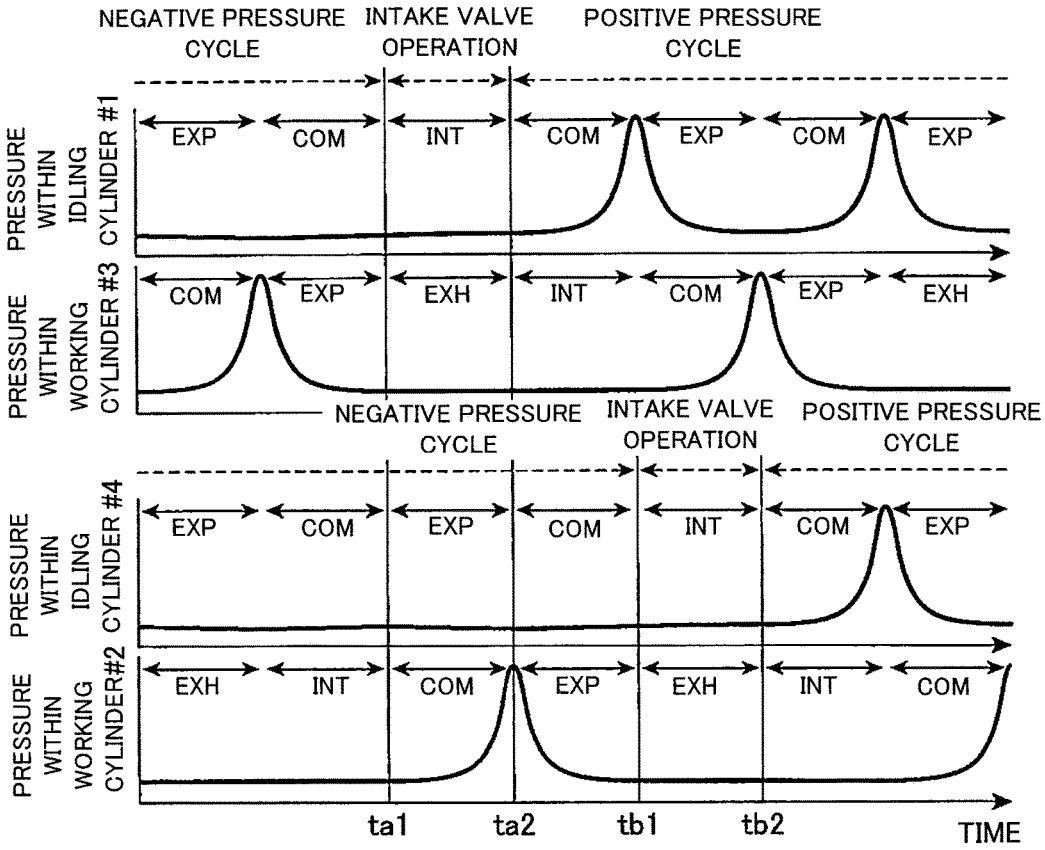
FIG. 19 is a figure showing changes over time of the cylinder internal pressures, according to a third embodiment.

As shown in FIG. 19, the ECU 30 implements intake strokes for the idling cylinders by opening and closing the intake valves 7 of cylinder #1, which is an idling cylinder, during the interval ta1-ta2, and also opening and closing the intake valves 7 of cylinder #4, which likewise is an idling cylinder, during the interval tb1-tb2. By implementing such intake strokes for the idling cylinders after cranking has started, a change is made from a negative pressure cycle in which expansion from atmospheric pressure and subsequent compression are repeated, to a positive pressure cycle in which compression from atmospheric pressure and subsequent expansion are repeated. Since, due to this, it is possible to maintain positive pressure within the idling cylinders after the internal combustion engine 3 has been restarted, accordingly it is possible to prevent oil from being sucked into the idling cylinders. It should be understood that it would also be acceptable to arrange to implement intake strokes for the idling cylinders two or more times.

Figure 20:
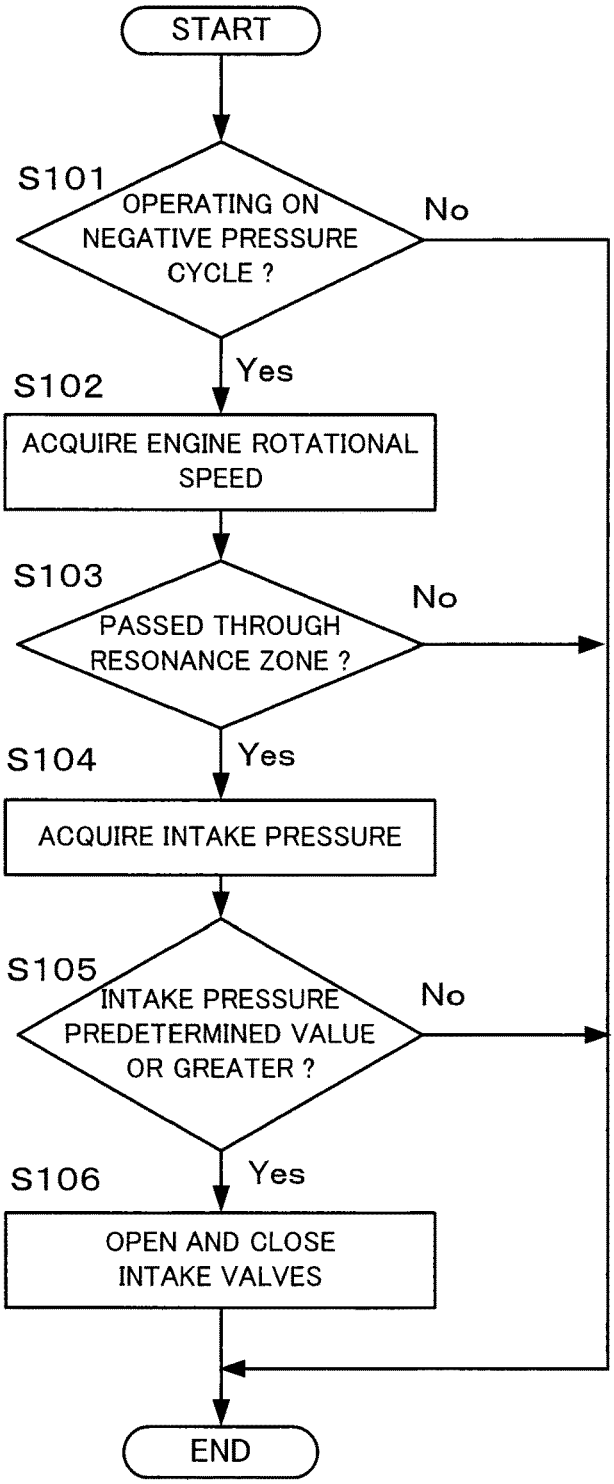
FIG. 20 is a flow chart showing an example of a control routine according to this third embodiment.

By implementing the control routine of FIG. 20, the ECU 30 functions as the "valve control device" of the Claims. A program for the control routine of FIG. 20 is stored in the ECU 30, and is read out in a timely manner and repeatedly executed on a predetermined cycle. In a step S101, the ECU 30 makes a decision as to whether or not the idling cylinders are operating on a negative pressure cycle. This decision is made on the basis of the value of the internal pressure in the cylinders, as measured by a pressure sensor provided within a cylinder. It should be understood that it would also be possible to estimate the cylinder internal pressure from other parameters that are correlated with the frictional torque or the cylinder internal pressure, and to implement the above decision on the basis of that estimated value. If the idling cylinders are operating on a negative pressure cycle then the flow of control proceeds to a step S102, whereas if the idling cylinders are not operating on a negative pressure cycle then the subsequent processing is skipped and this cycle of the routine terminates.

In the step S102, the ECU 30 refers to the signal from the crank angle sensor 29 and acquires the engine rotational speed. In the step S103, the ECU 30 makes a decision as to whether or not the engine rotational speed has passed through a resonance zone. It should be understood that this resonance zone means a region of engine rotational speed in which resonance is excited during the state of operating on a positive pressure cycle, and is not a region of engine rotational speed in which resonance is excited during the state of operating on a negative pressure cycle. If the engine rotational speed has passed through the resonance zone then the flow of control proceeds to a step S104, whereas if it has not passed through the resonance zone then the subsequent processing is skipped and this cycle of the routine terminates. In the step S104, the ECU 30 acquires the intake pressure by referring to the output signal of a pressure sensor 34 (refer to FIG. 1) that is provided in the intake passage 11. In a step S105, the ECU 30 makes a decision as to whether or not this intake pressure is greater than or equal to a predetermined value, in other words as to whether or not the intake pressure is the same as the predetermined value or has a value closer to atmospheric pressure than the predetermined value. This predetermined value is set to a pressure value that the air in the idling cylinders can reliably assume if the intake valves 7 are opened. If the intake pressure is greater than or equal to the predetermined value then the flow of control proceeds to a step S106, whereas if the intake pressure is less than the predetermined value then the subsequent processing is skipped and this cycle of the routine terminates. In the step S106, the ECU 30 opens and closes the intake valves 7 of the idling cylinders. In more detail, the ECU 30 opens the intake valves 7, and then closes the intake valves 7 after a predetermined time period has elapsed from when the intake valves 7 were opened. Due to this, it is possible to implement intake strokes for the idling cylinders.

According to this third embodiment, it is possible to prevent the sucking in of oil after restarting, since as described above a changeover is made from a negative pressure cycle to a positive pressure cycle. And in particular, with the control routine of FIG. 20, it is possible to avoid the system resonating after having changed over from the negative pressure cycle to the positive pressure cycle, since the idling stroke for the idling cylinders is implemented after having passed through the resonance zone during the positive pressure cycle.

Embodiment #4

Next, a fourth embodiment of the present invention will be explained with reference to FIGS. 21 through 23. This fourth embodiment is distinguished by control that is implemented along with the control of the first embodiment or of the third embodiment. Namely, the control of this fourth embodiment is a method in which, in the process in which the internal combustion engine 3 stops, it is arranged to implement at least one exhaust stroke for the idling cylinders by opening and closing the exhaust valves 8 of the idling cylinders.

Figure 21:
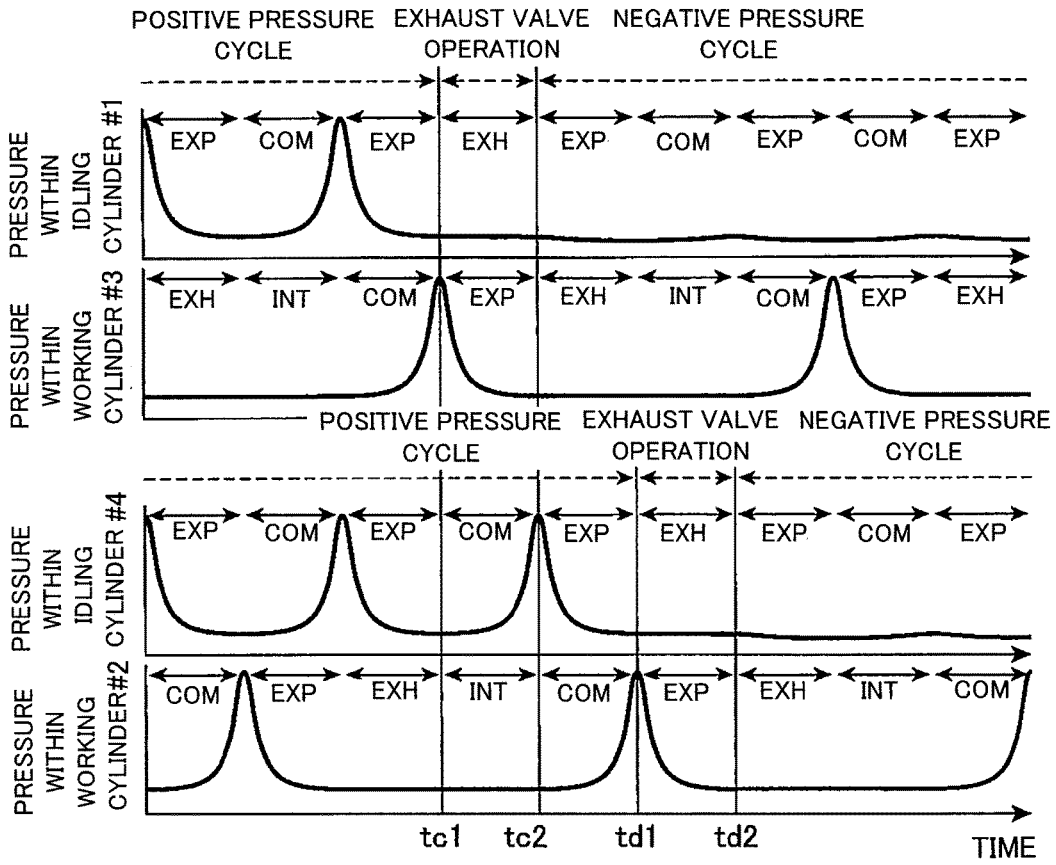
FIG. 21 is a figure showing changes over time of the cylinder internal pressures, according to a fourth embodiment.
Figure 22:
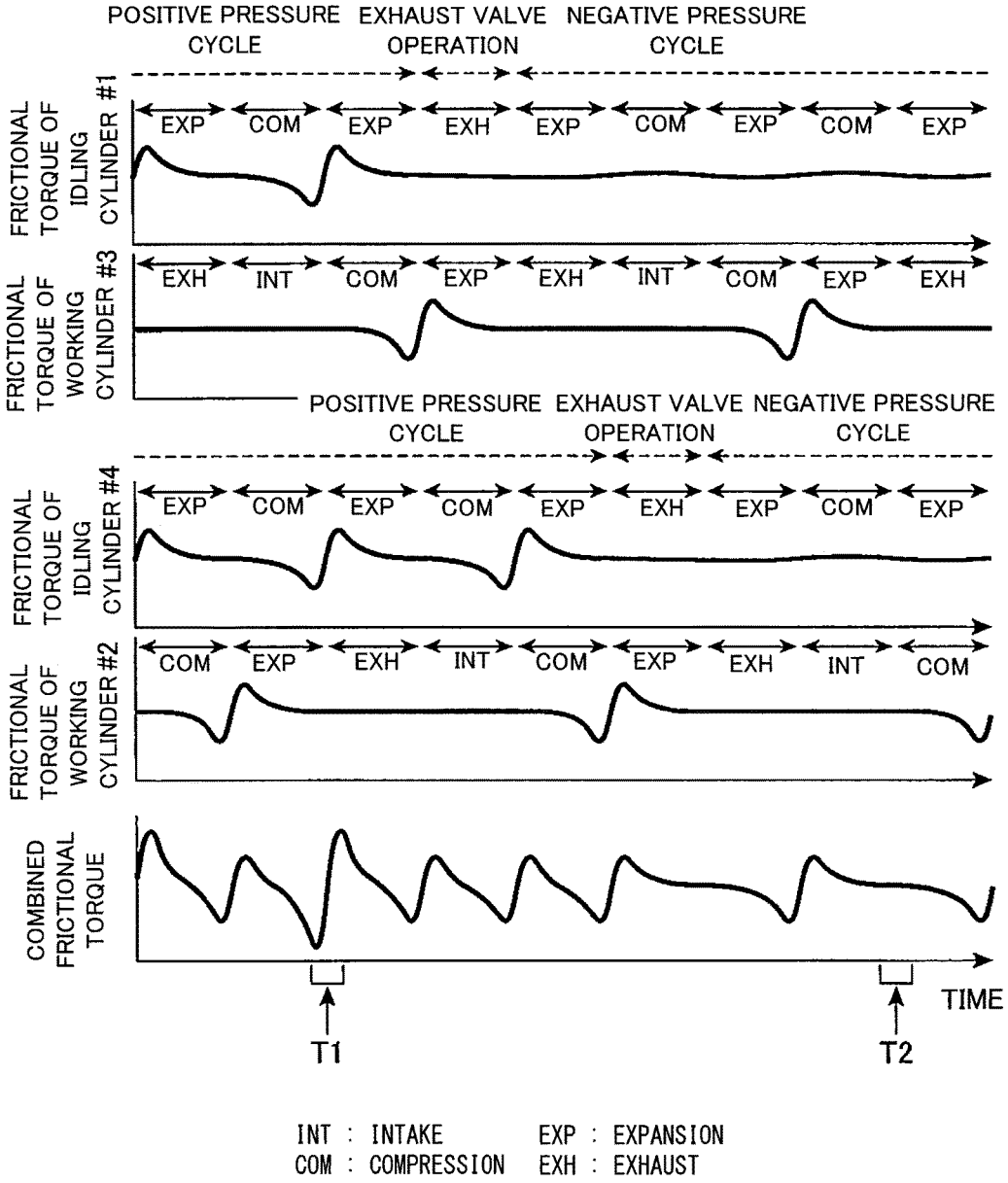
FIG. 22 is a figure showing changes over time of the frictional torques, according to this fourth embodiment.

As shown in FIG. 21, the ECU 30 implements exhaust strokes for the idling cylinders by opening and closing the exhaust valves 8 of cylinder #1, which is an idling cylinder, during the interval tc1-tc2, and also opening and closing the exhaust valves 8 of cylinder #4, which likewise is an idling cylinder, during the interval td1-td2. By implementing such exhaust strokes for the idling cylinders in the process of stopping the internal combustion engine, a change is made from a negative pressure cycle in which expansion from atmospheric pressure and subsequent compression are repeated, to a positive pressure cycle in which compression from atmospheric pressure and subsequent expansion are repeated.

As explained in connection with the first embodiment, in order to stop the piston position of an idling cylinder in the vicinity of its top dead center, it is necessary to stop the crankshaft 3*a* in the interval from just before the end of the compression stroke of the piston position of the idling cylinder to just after the start of its expansion stroke. As shown in FIG. 22, if the idling cylinder is operating on a positive pressure cycle, then, even if for example it is arranged to stop the crankshaft 3*a* in the interval T1, still the piston of the idling cylinder may undesirably accelerate after passing through its top dead center, since the fluctuations of the combined frictional torque are large. Due to this, it is difficult to stop the crankshaft 3*a* in the interval T1. By contrast, if the idling cylinder is operating on a negative pressure cycle, then it is easy to stop the crankshaft in, for example, the interval T2, since the fluctuations of the combined frictional torque are small in the interval from just before the end of the compression stroke of the piston position of the idling cylinder to just after the start of its expansion stroke. Accordingly there is the advantageous aspect that, by implementing the control of the fourth embodiment along with the engine stopping processing of the first embodiment, this processing is easy. It should be understood that it would also be acceptable to arrange to implement two or more exhaust strokes for the idling cylinders.

Figure 23:
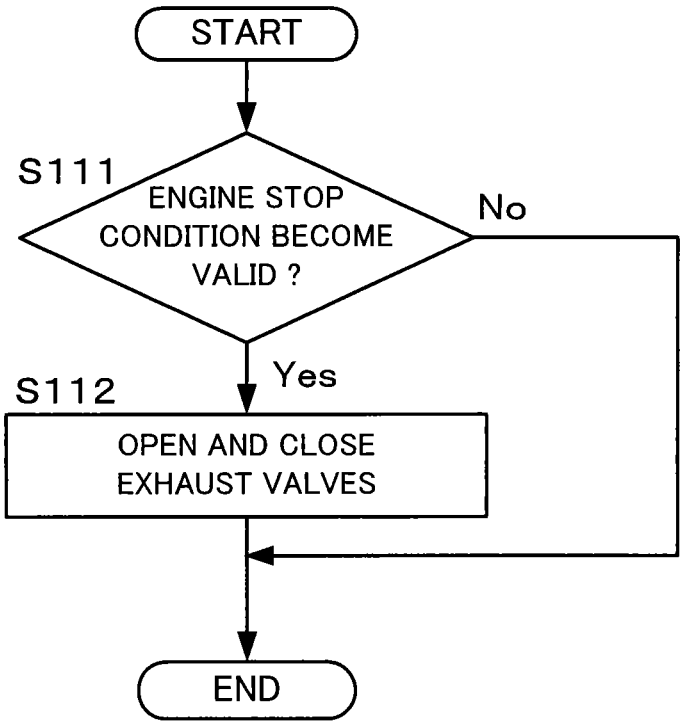
FIG. 23 is a flow chart showing an example of a control routine according to a fourth embodiment.

By implementing the control routine of FIG. 23, the ECU 30 functions as the "valve control device" of the Claims. A program for the control routine of FIG. 23 is stored in the ECU 30, and is read out in a timely manner and repeatedly executed on a predetermined cycle. In a step S111, the ECU 30 makes a decision as to whether or not an engine stop condition is valid. This processing is the same as that performed in the step S3 of FIG. 2. If the engine stop condition is valid then the flow of control proceeds to a step S112, whereas if the engine stop condition is not valid then the step S112 is skipped and this cycle of the routine terminates. In the step S112, the ECU 30 opens and closes the exhaust valves 8 of the idling cylinders. In other words, the ECU 30 opens the exhaust valves 8, and subsequently closes the exhaust valves 8 after having kept the exhaust valves 8 open for a predetermined time interval. By doing this, it is possible to implement exhaust strokes for the idling cylinders.

Embodiment #5

Figure 24:
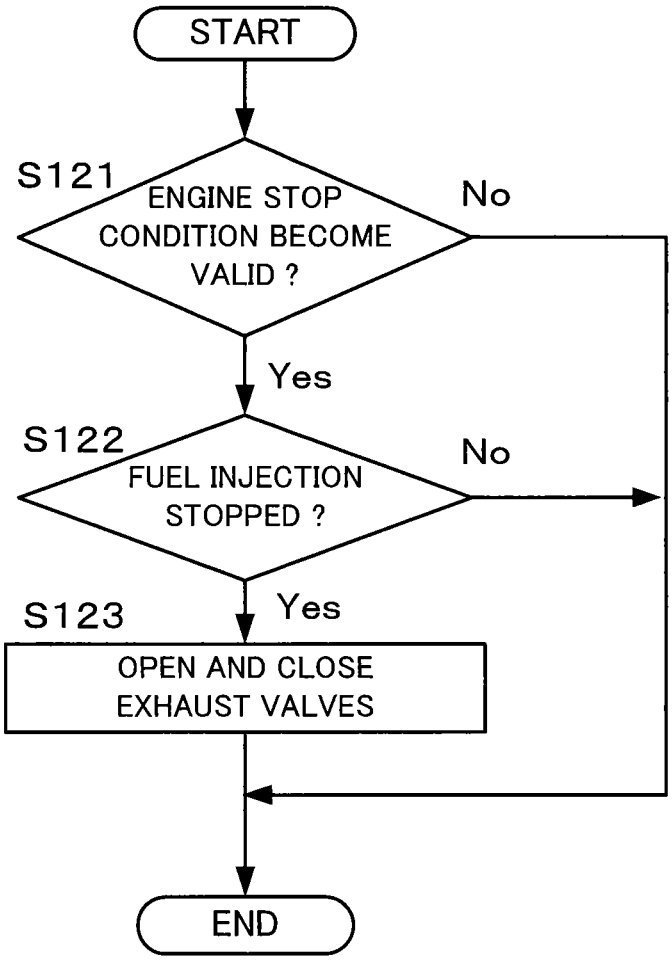
FIG. 24 is a flow chart showing an example of a control routine according to a fifth embodiment.

Next, a fifth embodiment of the present invention will be explained with reference to FIG. 24. The control of this fifth embodiment is equivalent to an improvement in the control of the fourth embodiment. Namely, in the control of this fifth embodiment, opening and closing of the exhaust valves 8 is implemented after having stopped fuel injection for the internal combustion engine 3. A program for the control routine of FIG. 24 is stored in the ECU 30, and is read out in a timely manner and repeatedly executed on a predetermined cycle. In a step S121, the ECU 30 makes a decision as to whether or not an engine stop condition is valid. This processing is the same as that in the step S111 of FIG. 23. If the engine stop condition has become valid then the flow of control proceeds to a step S122, whereas if the engine stop condition has not become valid then the subsequent processing is skipped and this cycle of the routine terminates. In the step S122, the ECU 30 makes a decision as to whether or not fuel injection to the internal combustion engine 3 has stopped. If fuel injection has stopped then the flow of control proceeds to a step S123, whereas if fuel injection has not stopped then the subsequent processing is skipped and this cycle of the routine terminates. In the step S123, the ECU 30 opens and closes the exhaust valves 8 of the idling cylinders, and implements exhaust strokes for the idling cylinders.

According to this fifth embodiment, the same beneficial effects can be obtained as in the case of the fourth embodiment. If an exhaust stroke is implemented before fuel injection has stopped, then exhaust that is discharged from the working cylinders after combustion and air that is discharged from the idling cylinders mix together so that the density of oxygen in the exhaust increases, and there is a fear that an exhaust purification catalyst such as the three-way catalyst 16 or the NOx catalyst 17 shown in FIG. 1 or the like may not function effectively. However, according to this fifth embodiment, it is possible to avoid this type of problem, since the exhaust strokes for the idling cylinders are implemented by opening and closing the exhaust valves 8 after fuel injection has stopped.

Embodiment #6

Figure 25:
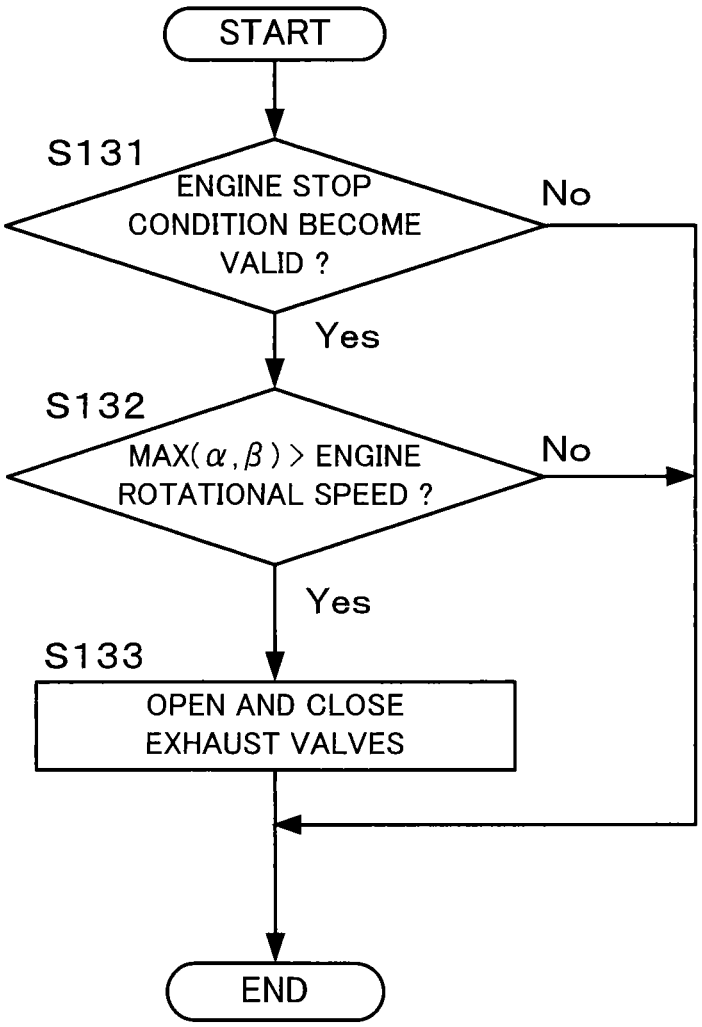
FIG. 25 is a flow chart showing an example of a control routine according to a sixth embodiment.
Figure 26:
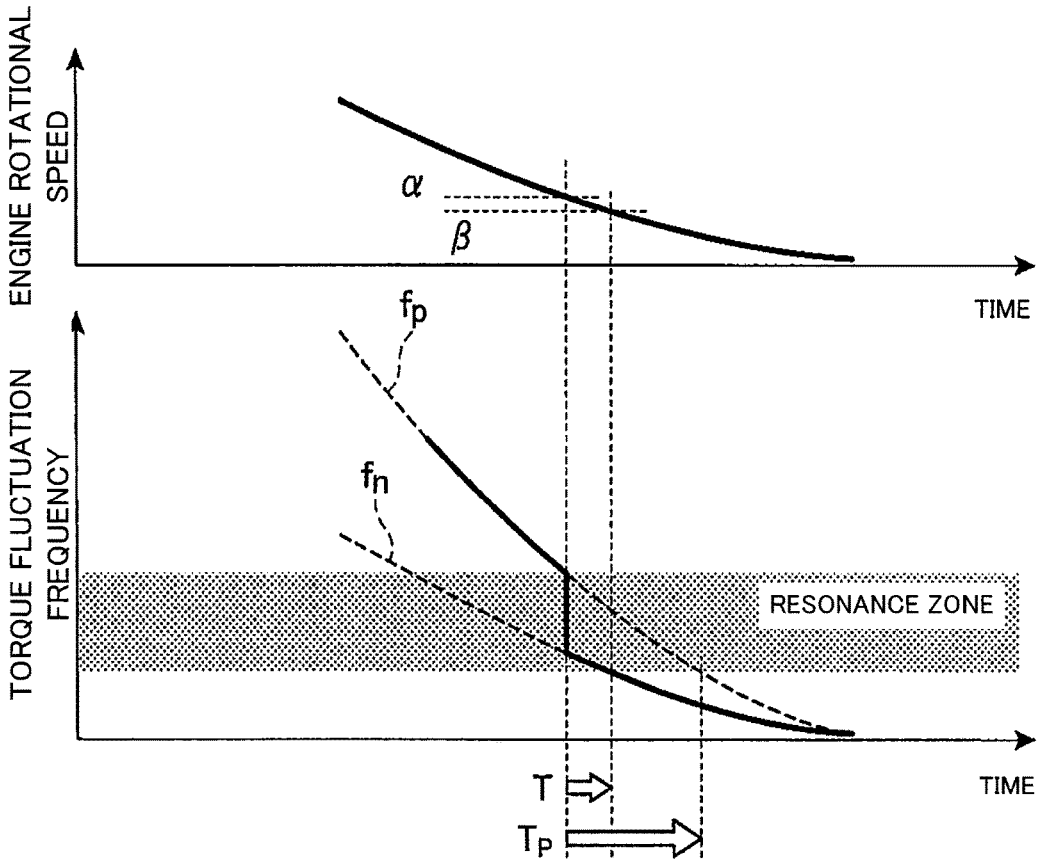
FIG. 26 is a figure showing changes over time of the engine rotational speed and the torque fluctuation frequency, when control according to the sixth embodiment is implemented.

Next, a sixth embodiment of the present invention will be explained with reference to FIGS. 25 and 26. The control of this sixth embodiment is equivalent to an improvement in the control of the fourth embodiment. The control of this sixth embodiment is characterized by the timing of the opening and closing of the exhaust valves 8. A program for the control routine of FIG. 25 is stored in the ECU 30, and is read out in a timely manner and repeatedly executed on a predetermined cycle. In a step S131, the ECU 30 makes a decision as to whether or not an engine stop condition is valid. This processing is the same as that performed in the step S111 of FIG. 23. If the engine stop condition has become valid then the flow of control proceeds to a step S132, whereas if the engine stop condition has not become valid then the subsequent processing is skipped and this cycle of the routine terminates. In the step S132, the ECU 30 makes a decision as to whether the engine rotational speed is less than an upper limit value $\alpha$ of the rotational speed region in which resonance is excited by a positive pressure cycle, or the engine rotational speed is less than a lower limit value $\beta$ of the rotational speed region in which resonance is excited by a negative pressure cycle. If an affirmative decision is reached in this step S132 then the flow of control proceeds to a step S133 and exhaust strokes for the idling cylinders are implemented by opening and closing the exhaust valves 8. On the other hand, if a negative decision is reached in this step S132 then the step S133 is skipped and this cycle of the routine terminates.

According to this sixth embodiment, exhaust strokes for the idling cylinders are implemented if the engine rotational speed is less than the upper limit value $\alpha$ of the rotational speed region in which resonance is excited by a positive pressure cycle, or if the engine rotational speed is less than the lower limit value $\beta$ of the rotational speed region in which resonance is excited by a negative pressure cycle. Due to this, the frequency of the torque fluctuations changes along the solid line. In other words, before passing through the resonance zone, the frequency of the torque fluctuations changes according to the frequency fp during a positive pressure cycle. And, since changeover is made to a negative pressure cycle when entering into the resonance zone, accordingly the frequency of the torque fluctuations changes according to the frequency fn of torque fluctuations during the negative pressure cycle, so that both the amplitude and the frequency of the torque fluctuations decrease. Due to this the time interval T for passing through the resonance zone is shortened, as compared to the passing through time interval Tp if the resonance zone were to be passed through while continuing the positive pressure cycle without alteration. As a result vibration is reduced, since it is possible to suppress resonance.

The present invention is not to be considered as being limited by the embodiments described above; it may be implemented in various different ways, provided that the scope of its gist is preserved. While, in the embodiments described above, the idling cylinders were set to predetermined piston positions by the engine stopping processing, it would also be possible to control the initial crank angle by controlling the first motor-generator 4 during the interval after stopping of the crankshaft 3*a* and before restarting thereof to rotate the crankshaft 3*a* so that the idling cylinders stop in predetermined piston positions.

Moreover while, in the first embodiment, control was performed so that the piston positions of the idling cylinders come to be near their top dead centers, it would also be acceptable for the piston positions of the idling cylinders not to be near their top dead centers, provided that the cylinder volumes of the idling cylinders are smaller than their maximum volumes. In other words, it will be acceptable to control the piston positions of the idling cylinders so that they are somewhat removed from their top dead centers.

If the internal combustion engine to which the present invention is applied is an internal combustion engine that is capable of changing over from reduced-cylinder operation to all-cylinder operation while the engine is stopped, then it would be acceptable to arrange for the internal combustion engine to be started in all-cylinder operation, if the engine stopping processing of the embodiments described above has not been implemented appropriately. Moreover, if the internal combustion engine to which the present invention is applied is an internal combustion engine that is capable of changing the number of idling cylinders while the engine is stopped, then it would be acceptable to arrange for the internal combustion engine to be started in all-cylinder operation, if the engine stopping processing of the embodiments described above has not been implemented appropriately. The number of cylinders of the internal combustion engine may be four or more; the number of cylinders of the internal combustion engine to which the present invention is applied is not to be considered as being particularly limited.

The present invention could also be implemented for a hybrid vehicle in which an internal combustion engine and a single electric motor are combined.

The invention claimed is:

1. A control apparatus for a hybrid vehicle comprising an internal combustion engine that has a plurality of four or more cylinders, the control apparatus implementing both a reduced-cylinder operation in which a portion among the plurality of cylinders is idled by stopping respective intake valves and exhaust valves in a closed state while a remaining cylinder operates and an all-cylinder operation in which all of the plurality of cylinders operate, the control apparatus comprising:

an electronic control unit configured to control a start of the internal combustion engine by controlling an electric motor of the hybrid vehicle to crank the internal combustion engine, configured to set an initial crank angle which is a crank angle when cranking is started to restart the internal combustion engine from a stopped state, and when the internal combustion engine is stopped during the reduced-cylinder operation and the internal combustion engine is restarted in the reduced-cylinder operation with same cylinders as idling cylinders, configured to set the initial crank angle so at least one cylinder among the idling cylinders is substantially at top dead center when cranking is started to restart the internal combustion engine.

2. A control apparatus according to claim 1, wherein:

with the internal combustion engine, during the reduced-cylinder operation, piston positions are the same for the idling cylinders and for working cylinders; and the electronic control unit controls the initial crank angle so that, when cranking starts, piston positions of the working cylinders reach bottom dead center through respective intake strokes after piston positions of the idling cylinders have first arrived at top dead center.

3. A control apparatus according to claim 1, wherein:

with the internal combustion engine, during the reduced-cylinder operation, the piston positions of the idling cylinders and working cylinders are different; and the electronic control unit controls the initial crank angle so that piston positions of the working cylinders are substantially at bottom dead center.

4. A control apparatus according to claim 1, wherein:

the electronic control unit is configured to, after the cranking starts, implement at least one time intake stroke for the idling cylinders by opening and closing the intake valve of the idling cylinders.

5. A control apparatus according to claim 1, wherein:

the electronic control unit is configured to, during a stopping process of the internal combustion engine, implement at least one time exhaust stroke for the idling cylinders by opening and closing the exhaust valve of the idling cylinders.

6. A control apparatus according to claim 5, wherein the electronic control unit implements at least one time exhaust stroke for the idling cylinders after fuel injection has stopped.

7. A control apparatus according to claim 1, wherein the at least one cylinder is adjusted to be substantially at top dead center when the internal combustion engine is stopped.

* * * * *